US005457007A

United States Patent [19]

Asami

[11] Patent Number: 5,457,007

[45] Date of Patent: Oct. 10, 1995

[54] COLOR IMAGING PROCESS USING LASER EXPOSURE TO ACHIEVE SUBTLE COLOR DENSITY GRADATIONS

[75] Inventor: Masahiro Asami, Kanagawa, Japan

[73] Assignee: Fuji Photo Film Co., Ltd., Kanagawa, Japan

[21] Appl. No.: 274,576

[22] Filed: Jul. 13, 1994

Related U.S. Application Data

[63] Continuation of Ser. No. 17,309, Feb. 12, 1993, abandoned.

[30] Foreign Application Priority Data

Feb. 14, 1992 [JP] Japan ..... 4-059766

[51] Int. Cl.[6] ..... G03C 7/18; G03C 7/30; G03C 7/384

[52] U.S. Cl. ..... 430/363; 430/359; 430/386; 430/387; 430/504; 430/506; 430/508; 430/944; 430/945

[58] Field of Search ..... 430/944, 945, 430/363, 504, 506, 508, 387, 359, 386

[56] References Cited

U.S. PATENT DOCUMENTS

| | | | |
|---|---|---|---|
| 2,763,549 | 9/1956 | Hanson, Jr. | 430/508 |
| 4,619,892 | 10/1986 | Simpson et al. | 430/505 |
| 4,729,943 | 3/1988 | Pfaff et al. | 430/504 |
| 4,746,599 | 5/1988 | Deguchi et al. | 430/504 |
| 4,806,460 | 2/1989 | Ogawa et al. | 430/506 |
| 4,902,609 | 2/1990 | Hahm | 430/506 |
| 4,946,765 | 8/1990 | Hahm | 430/504 |
| 4,956,702 | 9/1990 | McQuade et al. | 430/363 |
| 5,084,374 | 1/1992 | Waki et al. | 430/504 |
| 5,154,995 | 10/1992 | Kawai | 430/944 |
| 5,389,506 | 2/1995 | Sutton | 430/509 |
| 5,391,443 | 2/1995 | Simons et al. | 430/363 |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

The image forming process of the present invention includes subjecting a photosensitive material having at least one dye-forming layer for each of the three primary colors on a support to scanning exposure using light sources modulated in accordance with the image data, thereby reproducing a full color image of quality in which delicate shades in a high density color developed portion of high purity are reproduced stably. For the exposure dynamic range of the photosensitive material that the density of color generation of one dye-forming layer exhibiting the highest sensitivity to the light beam from at least one light source varies beyond the visual threshold with respect to a change of a modulation control minimum unit in the exposure quantity of said at least one light source, said one dye-forming layer is color generated by exposure to the light beam from another light source to which another dye-forming layer exhibits the highest sensitivity such that a variation of the color generation density of said one dye-forming layer may be below said visual threshold.

19 Claims, 7 Drawing Sheets

COLOR IMAGING PROCESS USING LASER EXPOSURE TO ACHIEVE SUBTLE COLOR DENSITY GRADATIONS

This a Continuation of application No. 08/017,319 filed Feb. 12, 1993.

BACKGROUND OF THE INVENTION

1. Field of the Invention

This invention relates to an image forming process for forming full color images of quality by subjecting full color photosensitive material to scanning exposure using light sources modulated in accordance with image data.

2. Prior Art

For photographic material using silver halide as a photosensitive element which is generally known as photographic silver halide photosensitive material, it is well known to form images by modulating laser light in accordance with recording signals, and scanning the photosensitive material with the modulated light. This system allows full color images of high precision to be produced using digital image information. Further the recent development of laser diodes has led to the manufacture of simple stable laser output devices. Image forming systems based on these technologies are expected. For example, U.S. Pat. Nos. 4,619,892 and 4,956,702 disclose color photographic silver halide photosensitive materials having sensitivities in the infrared region that can be exposed by beams emitted from laser diodes.

These processes of forming images using signals which are controlled in accordance with digital image information allow for synthesis of a plurality of image information bits and processing of an original image information bit in various ways, spreading their use to a wider variety of applications beyond the limit of the image forming process based on the conventional photographic technology.

The photosensitive material used as an image output medium involves a color reproduction mechanism based on the subtractive color process using yellow, magenta and cyan dyes as the three primary colors like the conventional color photographic photosensitive material. Since exposure for digitally controlling the generation of the three primary colors can be done independently for each color, color generation can be controlled at a higher degree of freedom than the conventional color photography using color negative and color paper.

In particular, laser light sources including semiconductor lasers such as laser diodes and gas lasers emit light beams having a narrow band of wavelength. Then the use of laser light sources has some advantages. Even when a color photosensitive material having wavelength-dependent spectral sensitivity is exposed, for example, the three primary colors can be independently generated by using a plurality of (three in this case) laser light sources emitting laser beams having different narrow band wavelengths. Also when a color photosensitive material which has overlapping tails of adjacent spectral sensitivity curves and which insufficiently separates color is exposed with the laser beam of a semiconductor laser whose oscillation wavelength can vary to a wavelength region causing color mixing, it is proposed to electrically process image signals so as to prevent color mixing and to increase color purity. Also proposed are photosensitive materials featuring better separation of the three primary colors, which provide more freedom to the independent control on the generation of the three primary colors. Then in the case of digital exposure, some provisions for increasing the saturation of a color to be reproduced, for example, can be made in delivering original image information outputs. In practice, several image processing techniques have been attempted.

The method for carrying out digital exposure on photosensitive material using semiconductor laser includes a light intensity modulation mode of modulating the intensity of laser light in accordance with the density of an image and a time duration (pulse width) modulation mode of modulating the light emitting time in accordance with the density of an image. The light intensity modulation mode involves delivering light intensity signals corresponding to the image density as modulation signals, and increasing or decreasing the current flow applied to the semiconductor laser in accordance therewith to adjust the output of laser light per unit time, thereby changing the exposure quantity for forming a graded image. The time duration modulation mode involves delivering time duration signals corresponding to the image density as modulation signals, and changing the duration of conduction of a semiconductor laser to increase or decrease the output time duration, thereby changing the exposure quantity for forming a graded image.

Output signals for modulating an exposure light source which may either be light intensity modulating signals or pulse width modulating signals are obtained from original image data by performing computation using the following conversion formulae:

$$Ce=f(Ro, Go, Bo),$$

$$Me=g(Ro, Go, Bo), \text{ and}$$

$$Ye=h(Ro, Go, Bo)$$

wherein Ro, Go, and Bo represent red (R) , green (G) , and blue (B) signals of the original image data, respectively, and Ce, Me, and Ye represent output signals for exposure light source control corresponding to the cyan, magenta and yellow dye-forming layers, respectively.

For the purpose of increasing the purity of a reddish color which is to be reproduced, conversion in accordance with the following expression:

$$Ce=Ce[1-\alpha(Ye+Me)]$$

may also be utilized. The turbidity of the reddish color can be reduced by setting the value of $\alpha$ to an appropriate positive number.

In practice, the computation formulae can be varied due to various properties of the photosensitive material to be used as an output medium, for example, the absorption properties a color developing dye and sensitivity. Then in designing a particular image forming system, these computation formulae must be determined from the properties of the equipment and photosensitive material used. The characteristics of the functions f,g, and h and actual values of $\alpha$ may be determined, for example, by performing color matching between the original image and an output image for several tens to several thousands of colors in accordance with the method of least squares.

Formation of full color images using photographic silver halide photosensitive material enables high density recording as compared with other methods such as dye sublimation transfer, electrophotography and ink-jet printing methods, resulting in images being improved in such quality factors as granularity, sharpness and gradation reproduction. Therefore, by writing in image information according to this method, images of high quality which could otherwise be established only in the analog system as represented by photography can be obtained from digital signals as hard copies.

Investigating the system for writing in images in photographic silver halide photosensitive material, especially featuring improved color separation, by scanning exposure using a laser light source modulated in accordance with digital image information, we found an unexpected problem in reproducing original images. That is, the delicate graded depiction of highly color generated areas of an image having high saturation varies, and it is thus difficult to obtain a stable image output. More particularly, in reproducing a reddish image having high saturation, for example a crimson rose and a red velvet dress, there occurs a phenomenon that the depiction of delicate shades varies, leaving a serious obstruction in reproducing an image of quality in a stable manner.

In general, in color reproduction by the subtractive color process, delicate shades in areas having high degrees of saturation and color generation are represented by the ratio of that color to a color complementary thereto. With only those colors having high purity, depiction is saturated within the range between minimum and maximum degrees of color generation so that only a narrow range can be depicted. For example, shades in a high density area of high purity red are depicted by a change in the color generation proportion of a cyan component starting from near the highest density of red color generation. As the proportion of a cyan component varies from the minimum to the highest density of color generation, the color changes from highly pure red to achromatic black.

It is therefore understood that in order to consistently express delicate shades in highly color generated areas of highly pure red, the color generation of a low density cyan component responsible for their reproduction must be controlled as precisely as possible. Differently stated, a variation in color generation of such a low density component is presumed to cause inconsistency in the reproduction of delicate shades as previously described.

This problem becomes more outstanding in those shaded areas having high degrees of saturation and color generation among the original image information. This is because the control of a light source is not carried out in a fully stable manner in those portions in which output signals for modulating an exposure light source in accordance with the image signal are of small values.

Semiconductor lasers such as laser diodes have characteristic curves of their light output which include high and low light output regions in which the characteristic curve of light output is linear and non-linear relative to the input signal level, respectively. The semiconductor laser is not sufficiently stable to accurately control the color generation density of cyan, for example, for depicting delicate shades in a low light output or non-linear region, thus failing to achieve good gradation. Also, if the level of light output is further reduced, no laser oscillation occurs such that an output region for light emitting diodes and optical elements for laser beams cannot provide full control. In contrast, even when a complementary color is generated for the depiction of delicate shades by pulse width modulation using a light output in the linear region of this laser, the pulse width is significantly reduced, stable control becomes difficult, and good graded depiction is not available.

On the other hand, in order to adequately adjust the exposure quantity of a light source in proportion to a density, it is contemplated to logarithmically vary the exposure quantity, which in turn, may be achieved by logarithmically varying the value of modulation control output signals for setting the intensity or time duration of laser beams or other light beams. Since it is, however, very difficult to construct such a control circuit, a general practice is to anti-logarithmically vary a control quantity in an arithmetic manner. For example, when the modulation of a light source is controlled using a micro-computer, an equal number of modulation control signals to the number of combinations of bits in one byte are obtained so that a constant change of the output is available per modulation control signal.

As a result, as shown by solid lines in FIG. 4, in a region having an increased exposure quantity (and hence an increased image density), a change $\Delta \log E$ of the logarithmic value of an exposure quantity corresponding to a change $\Delta S$ of a modulation control signal is small and the corresponding differential density $\Delta D_1$ is small. in a region having a reduced exposure quantity (and hence a reduced image density), a change $\Delta \log E$ of the logarithmic value of an exposure quantity corresponding to the change $\Delta S$ of the modulation control signal as above is large and the corresponding differential density $\Delta D_2$ is very large. Accordingly, there is a problem that if the visual threshold is exceeded, a density difference or density leap $\Delta D_2$ occurs in a low density region, failing to achieve good gradation and lowering reproduction ability.

Therefore, such a modulation control system is difficult to achieve color generation at a sufficiently low density to depict delicate shades and fails to achieve stable gradation. There is an additional problem that a density variation in shades becomes more outstanding with a lower density of a complementary color added as the shades. It was also found that the magnitude of such a variation is further increased if the signal processing for increasing the saturation of a pure color as mentioned above is employed.

U.S. Pat. Nos. 4,619,892 and 4,956,702, referred to above, describe the construction of exemplary laser writing photosensitive materials by combining color couplers capable of forming yellow, magenta and cyan dyes through a coupling reaction with an oxidized form of an aromatic primary amine developing agent with a silver chlorobromide emulsion which is spectrally sensitized in an infrared region. The techniques disclosed in these patents produce full color images by sensitizing at least two photosensitive layers in the infrared region and subjecting them to scanning exposure by means of a semiconductor laser. According to their teaching, the serious problem of deteriorated color separation induced by a broad spectral sensitivity distribution resulting from infrared sensitization is solved by providing a differential sensitivity or a filter layer between the photosensitive layers. Therefore, what is disclosed by the patents is to provide a color having as high as possible purity. Such a method, is difficult to achieve consistent reproduction of delicate shades in areas having high degrees of purity and color generation as previously described.

Regarding conventional color photographic silver halide photosensitive material, U.S. Pat. No. 4,806,460 discloses the use of a photosensitive material in which for the purpose of increasing the reproduction latitude of a color of high purity, in a particular image region in which the image density of one dye is at or above a certain value set between 1.2 and 2.5, one dye having a hue which does not substantially contribute to formation of the hue of the particular image is added while providing gradation. However, this technique is to enhance the shades in colors of high purity in prints resulting from conventional negative films and thus completely different from the technique of eliminating a variation in the depiction of graded detail which becomes a problem in writing using a light source modulated using image data as in the present invention.

This is explained as follows. If it is only desired to depict shades in colors of high purity, it is naturally presumed that the writing system using a plurality of light sources which are independently modulated in accordance with image data has the flexibility of changing the magnitude of modulation. Therefore, the problem to be solved by the present invention, the occurrence of a variation in the reproduction of shades in highly color generated portions of a high saturation color is a new problem which is first recognized when writing from image data is performed.

Moreover, the technique of U.S. Pat. No. 4,806,460 relates to the addition of spectral sensitivity to a region corresponding to a complementary color to the spectral sensitivity distribution of one photosensitive layer and simultaneous color generation of a dye of high purity and a dye corresponding to a complementary color thereto. In this regard too, this patent employs a different technique than the present invention.

SUMMARY OF THE INVENTION

Therefore, an object of the present invention is to provide a novel and improved image forming process which overcomes the above-mentioned problems of the prior art techniques, and which involves subjecting a photosensitive material having at least one dye-forming layer for each of the three primary colors on a support to scanning exposure using light sources modulated in accordance with image data, thereby forming in the photosensitive material a full color image of quality in which delicate shades in a highly color generated portion of a high purity color are stably reproduced.

According to a first aspect of the invention, there is provided a process for forming an image comprising the steps of modulating a plurality of light sources adapted to emit a corresponding plurality of light beams having different narrow band wavelengths in accordance with image data, and writing the image in a photosensitive material having on a support at least one layer for forming a dye of different color exhibiting maximum sensitivity to each of the light beams. For the exposure dynamic range of the photosensitive material that the density of color generation of one dye-forming layer of one color exhibiting the highest sensitivity to the light beam from at least one light source varies beyond the visual threshold with respect to a change of a modulation control minimum unit in the exposure quantity of said at least one light source, said one dye-forming layer is color generated by exposure to the light beam from another light source to which another dye-forming layer exhibits the highest sensitivity such that a variation of the color generation density of said one dye-forming layer may be below said visual threshold with respect to a change of a modulation control minimum unit in the exposure quantity of said at least one light source.

In one preferred embodiment, the photosensitive material has at least a yellow dye-forming layer, a magenta dye-forming layer and a cyan dye-forming layer on the support, the plurality of light sources are at least three laser light sources having different oscillation wavelengths, and modulation of the plurality of light sources is carried out in accordance with a signal conversion scheme computed from R, G and B components of the image data, respectively.

According to a second aspect of the invention, there is provided a process for forming a color image comprising the steps of modulating a plurality of light sources in accordance with image data, and writing the image in a photosensitive material having on a support at least a yellow dye-forming layer, a magenta dye-forming layer and a cyan dye-forming layer. The plurality of light sources include at least three laser light sources having different oscillation wavelengths. Modulation of said plurality of light sources is carried out in accordance with a signal conversion scheme computed from R, G and B components of the image data, respectively. At least one laser light source is capable of causing more than one emulsion layer to generate their color upon sole exposure to said light source. The setting of the oscillation wavelength of the laser light source and/or the spectral sensitivity distribution of the photosensitive layers is adjusted such that within the exposure dynamic range of the emulsion layer of the highest sensitivity among the plurality of emulsion layers that have generated their color upon sole exposure to said light source, at least one of color generating dyes complementary to the color generating dye corresponding to said photosensitive layer is additionally color generated while providing a gradation.

According to a third aspect of the invention, there is provided a process for forming an image comprising the steps of modulating a plurality of light sources in accordance with image data, and writing the image in a photosensitive material having on a support at least a yellow dye-forming layer, a magenta dye-forming layer and a cyan dye-forming layer. Modulation of said plurality of light sources is carried out in accordance with a signal conversion scheme computed from R, G and B components of the image data, respectively. At least one light source is capable of causing color generation of plural emulsion layers including the emulsion layer exhibiting the highest sensitivity upon sole exposure thereto and another emulsion layer containing a color generating dye complementary to the color generating dye of said highest sensitivity emulsion layer. For the exposure dynamic range of the photosensitive material that the density of color generation of said complementary dye upon exposure to another light source capable of color generation of said emulsion layer of said complementary dye to the highest sensitivity varies beyond the visual threshold with respect to a change of a modulation control minimum unit in the exposure quantity of said other light source, said complementary dye is color generated by said one light source capable of causing color generation of plural emulsion layers such that a variation of the color generation density thereof is below the visual threshold.

In one preferred embodiment, color generation of the complementary dye upon sole exposure to said one light source capable of causing color generation of plural emulsion layers is added to a density region above a certain value set between 1.5 and 2.5 in the image density of the color generating dye of the emulsion layer exhibiting the highest sensitivity upon sole exposure to said one light source while providing a gradation.

Also preferably in the second and third aspects, the magenta dye-forming layer in said photosensitive material contains a dye forming element in the form of a compound capable of forming a magenta dye through coupling reaction with an oxidized form of an aromatic primary amine developing agent. In the absorption spectrum profile of the photosensitive material provided on color generation of monochromatic magenta, the following relationship is met:

$$K\,(br) \leqq .56 \text{ or } K\,(rr) \leqq .18 \qquad (1)$$

where the photosensitive material uses a reflective support, or $$K(bt) \leqq .44 \text{ or } K(rt) \leqq .09 \quad (2)$$

where the photosensitive material uses a transparent support.

Further preferably, the magenta dye-forming layer in the photosensitive material contains a dye forming element in the form of a compound capable of forming a magenta dye through coupling reaction with an oxidized form of an aromatic primary amine developing agent, said compound being represented by the general formula (I):

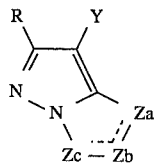

(I)

wherein R is a hydrogen atom or a substituent radical,

Y is a hydrogen atom or a coupling-off radical, and

Za, Zb, and Zc are selected from the group consisting of methine, substituted methine, =N—, and —NH—, and form a five-membered azole ring containing two to four nitrogen atoms.

According to the image forming process of the invention, a plurality of light sources, for example, adapted to emit light beams having different narrow band wavelengths are modulated in accordance with image data. A photosensitive material comprising on a support at least a corresponding plurality of dye-forming layers exhibiting maximum sensitivity to the corresponding light beams, for example, at least a yellow dye-forming layer, a magenta dye-forming layer and a cyan dye-forming layer is scanning exposed to the modulated light beams. Among exposure dynamic ranges of the photosensitive material associated with one color, for the modulation range in which modulation control of the exposure quantity of the light source causing generation of the one color is unstable and thus causes a density variation beyond the visual threshold, that is, the low density color generating exposure quantity range, another light source is modulated in the range in which modulation control of the exposure quantity of the other light source is stable, that is, the high density color generating exposure quantity range of the dye exhibiting the highest sensitivity to the other light source whereby the low density color is generated with a density variation below the visual threshold.

According to the image forming process of the invention, using at least one light source, the emulsion layer exhibiting the highest sensitivity upon exposure to the light source, that is, the dye forming layer, is color generated with a gradation within the exposure dynamic range of a photosensitive material. Then the wavelength of the light source and/or the spectral sensitivity distribution of the photosensitive material is adjusted such that the spectral sensitivity distribution of the photosensitive layer relative to the oscillation wavelength of the light source, for example, laser light source has a predetermined relationship, that is, the highest sensitivity color and a color complementary thereto are simultaneously generated with a single light source. The color generation of the complementary color is accompanied by a gradation within the density range between 1.5 and 2.5 of the color generating dye of the highest sensitivity emulsion layer.

Then the image forming process of the invention ensures that upon sole exposure to a single light source, the high density color is generated and at the same time, the low density color generation of a dye complementary thereto is induced in a stable manner to provide a fine density variation, that is, a density variation below the visual threshold. Then the depiction gradation range of a highly color generated portion of an image with high saturation can be stably expanded. For example, a crimson rose flower or red velvet dress can be stably reproduced as an image of quality including details with delicate shades.

The invention becomes more effective when the absorption spectrum profile of the magenta dye satisfies the above-defined formula (1) or (2). K(br) and K(rr) are defined in conjunction with a photosensitive material having a reflective support. When the magenta dye is monochromatically formed, the absorption spectrum measured at the color generation density at which the absorption maximum in the visible region of the reflection absorption spectrum becomes Abs.=1.0 has an absorption profile. Then K(br) and K(rr) are defined as the ratio of the area of reflection density between 410 nm and 510 nm to the area of reflection density between 510 nm and 600 nm and the ratio of the area of reflection density between 600 nm and 700 nm to the area of reflection density between 510 nm and 600 nm in this absorption profile, respectively. K(bt) and K(rt) are defined in conjunction with a photosensitive material having a transparent support. When the magenta dye is monochromatically formed, the absorption spectrum measured at the color generation density at which the absorption maximum in the visible region of the transmission absorption spectrum becomes Abs.=1.0 has an absorption profile. Then K(bt) and K(rt) are defined as the ratio of the area of transmission density between 410 nm and 510 nm to the area of transmission density between 510 nm and 600 nm and the ratio of the area of transmission density between 600 nm and 700 nm to the area of transmission density between 510 nm and 600 nm in this absorption profile, respectively.

These values are conveniently measured as follows. First a sample in which a photosensitive material does not undergo color generation at all is prepared and used as a reference. Such a reference may be prepared, for example, if a photosensitive material includes a dye forming element in the form of a compound capable of forming a dye through coupling reaction with an oxidized form of an aromatic primary amine developing agent, by processing the photosensitive material through a process from which a color developing bath is omitted.

Next, a sample for measurement is prepared by processing a photosensitive material under such conditions that the magenta dye is singly formed while adjusting color generation such that the absorption maximum of the magenta dye becomes Abs.=1.0.

An absorption profile of the magenta dye is obtained by measuring the reflection or transmission absorption spectrum of the magenta color generated test sample relative to the reference. From this absorption profile, K(br) and K(rr) for the photosensitive material having a reflective support and K(bt) and K(rt) for the photosensitive material having a transparent support can be calculated.

In one preferred embodiment of the invention wherein the photosensitive material has a reflective support, better results are obtained when K(br) is not more than 0.56 or K(rr) is not more than 0.18. The invention is most effective when both the requirements are met.

Also in another preferred embodiment of the invention wherein the photosensitive material having a transparent support, better results are obtained when K(bt) is not more than 0.44 or K(rt) is not more than 0.09. The invention is most effective when both the requirements are met.

In order that the invention be more effective, a magenta coupler of general formula (I) is used.

In formula (I), R is a hydrogen atom or a substituent radical. Y is a hydrogen atom or a coupling-off or eliminatable radical such as a halogen atom, aryloxy radical, arylthio radical and pyrazole radical. Za, Zb, and Zc are selected from the group consisting of methine, substituted methine, =N—, and —NH—, and form a five-membered azole ring containing two to four nitrogen atoms. One of the Za—Zb and Zb—Zc bonds is a double bond and the other is a single bond. Where the Zb—Zc bond is a carbon-to-carbon double bond, it may be a part of an aromatic ring. Where R or Y forms a dimer or polymer and Za, Zb or Zc is a substituted methine, the substituted methine may form the dimer or polymer.

DETAILED DESCRIPTION OF THE INVENTION

Figure 1:
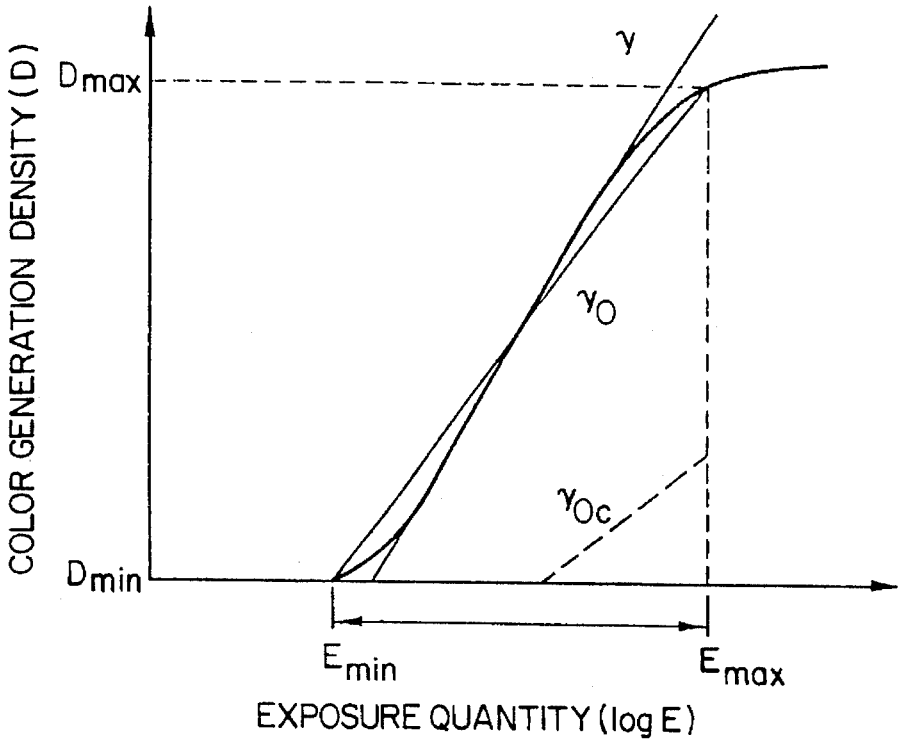
FIG. 1 is a graph showing the sensitivity curve of one exemplary photosensitive material used in the image forming process of the invention.

The light sources used in the image forming process of the present invention are not particularly limited insofar as they can emit light beams in different wavelength regions adapted for exposure of respective dye forming layers of different colors, typically the three primary colors, included in a photosensitive material. Preferred is a light source for emitting a light beam having a predetermined wavelength region at which a dye forming layer of one color exhibits maximum sensitivity, for example, a predetermined narrow band wavelength to be simply referred to as predetermined wavelength. Such a light source is used for every color, for example, three light sources are used for the three primary colors, or four light sources are used for the three primary colors plus black. The suitable light sources include light sources for emitting a light beam having a predetermined narrow band wavelength, for example, semiconductor lasers such as laser diodes (LD), laser light sources such as solid state lasers and gas lasers, and light emitting diodes, combinations of any of these light sources with a SHG element for reducing the wavelength of the light beam emitted by that light source to a shorter wavelength, for example, to a one-half wavelength, and combinations of a multi-wavelength light source with a spectral means. Any combination of these light sources is also acceptable.

In the image forming process of the present invention, the combination of the sensitive wavelength of the photosensitive material with the wavelength of each of exposure light sources for recording an image may be selected from a wide range ranging from the visible region to the infrared region.

Where laser light sources are used as the exposure light source, a gas laser oscillating in the visible region, a semiconductor laser oscillating from red to the infrared region, or a laser light source utilizing a SHG element for converting the oscillation wavelength of a semiconductor laser to a shorter wavelength may be used in any desired combination. Among the currently available light sources, the semiconductor lasers or combinations thereof with SHG elements are advantageous since they allow for a compact design.

Any desired photosensitive material may be used in the practice of the present invention insofar as it has on a support at least one dye-forming layer for each of different colors, the dye-forming layers exhibiting a maximum sensitivity to the corresponding light beams having different narrow band wavelengths, for example, at least one dye-forming layer for each of the three primary colors, typically at least a yellow dye-forming layer, a magenta dye-forming layer, and a cyan dye-forming layer. Exemplary useful methods on which the photosensitive material used herein can rely include the method of forming dyes through color development, that is, using a color coupler capable of forming a dye through coupling reaction with an oxidized form of an aromatic primary amine developing agent as a dye-forming element as disclosed in U.S. Pat. Nos. 3,761,270 and 4,021,240; the method of releasing or forming a diffusible dye imagewise through heat development and transferring the diffusible dye to a dye-fixing element (this system allows either negative or positive images to be obtained by changing the type of a dye-providing compound or the type of a photosensitive element used) as disclosed in U.S. Pat. Nos. 4,500,626, 4,483,914, 4,503,137 and 4,559,290, JP-A 149046/1983, 218443/1984, 133449/1985 and 238056/1986, EP 0210660 A2 and 0220746 A2, and Technical Report 87-6199; and the method of forming positive images by photosensitive silver dye bleaching as disclosed in U.S. Pat. No. 4,235,957.

For exposure of such a photosensitive material, especially a photosensitive material having at least a yellow dye-forming layer, a magenta dye-forming layer, and a cyan dye-forming layer, the aforementioned light sources, especially laser light sources are used while they are modulated. Any modulation method may be used which can modulate the light sources so as to provide exposure quantities corresponding to the original image data (image data of an original image or document image). In one preferred embodiment, for example, image data signals of the three primary colors, red (R), green (G) and blue (B) for each pixel in an original image are modulated into sufficient exposure quantities of the light sources emitting light beams to cause color generation of the respective dye-forming layers, that is, exposure quantities of the light sources for cyan (C), magenta (M) and yellow (Y) color generation. The yellow dye-forming layer, magenta dye-forming layer, and cyan dye-forming layer included in the photosensitive material are preferably color generated at their maximum sensitivity by the respective light sources for yellow, magenta and cyan color generation.

The conversion formulae for converting input image signals $R_i$, $G_i$ and $B_i$ for a pixel i in an original image into output image signals $C_i$, $M_i$ and $Y_i$ for pixel i (exposure quantity signals of each light source) are given below.

$$C_i = f(R_i, G_i, B_i)$$

$$M_i = f(R_i, G_i, B_i)$$

$Y_i = f(R_i, G_i, B_i)$

Other image signal conversion systems include a 3×3 color compensation matrix and three-dimensional interpolation, for example. A conversion formula based on the 3×3 color compensation matrix is given by the following formula:

$$\begin{bmatrix} C_i \\ M_i \\ Y_i \end{bmatrix} = \begin{bmatrix} a_{11} & a_{12} & a_{13} \\ a_{21} & a_{22} & a_{23} \\ a_{31} & a_{32} & a_{33} \end{bmatrix} \cdot \begin{bmatrix} R_i \\ G_i \\ B_i \end{bmatrix}$$

wherein $a_{11}$ to $a_{33}$ are coefficients of correction for the properties of photosensitive material, light sources, filter or the like.

The exposure quantity E is expressed as E=Pxt wherein P is the light output of a light source and t is the light emitting time of the light source, that is, exposure time. Then in a digital image processing system wherein light sources such as LDs are operated to emit light in pulses in accordance with digital signal values, the pulse width modulation (PWM or exposure time modulation) for causing continuous light emission only for a time corresponding to a digital signal value for each pixel with the light output set constant implies that image output signals ($C_i$, $M_i$, $Y_i$) correspond to digital exposure time signal values for pixel i. The emission power modulation (PAM or pulse amplitude modulation) for causing respective light sources to emit light in light outputs corresponding to digital signal values with the exposure time set constant implies that image output signals ($C_i$, $M_i$, $Y_i$) correspond to digital light output signal values for pixel i. The exposure number modulation (PNM or pulse number modulation) for causing respective light sources to emit light a number of times corresponding to digital signal values for each pixel with the light output and the exposure time per single exposure set constant implies that image output signals ($C_i$, $M_i$, $Y_i$) correspond to digital exposure number signal values for pixel i.

Moreover, in the present invention, the light source for each color may produce combinations of light output P and exposure time t such as $\{(P_{Ci}, t_{Ci}), (P_{Mi}, t_{Mi}), (P_{Yi}, t_{Yi})\}$ as image output signals ($C_i$, $M_i$, $Y_i$) for each pixel.

Although exemplary signal conversion means used in the present invention are 3×3 color compensation matrix computation and three-dimensional interpolation as mentioned above, any signal conversion means which can convert (R, G, B) input signals into (C, M, Y) output signals may be used. Also acceptable is a system for converting four color input signals including (R, G, B) full color input signals plus a black (BK) input signal into four color output signals including (C, M, Y) full color output signals plus a black (BK) output signal.

The exposure quantity conversion system used herein is to determine the exposure quantity (C, M, Y) of respective light sources C, M, Y for each pixel and to deliver the light output, exposure time duration, or exposure number of respective light sources in accordance with the exposure quantity while these conversion contents may be tabulated as an exposure quantity look-up table (LUT).

According to the present invention, the aforementioned photosensitive material, typically that having at least one layer for each of yellow, magenta and cyan dye-forming layers is exposed to an original image (document image) using the aforementioned light sources, typically laser light sources. Therefore, in the practice of the invention, on color generation of each of dye-forming layers each exhibiting maximum sensitivity to exposure to a single light beam emitted from the corresponding one of light sources, especially on color generation at a low density of a dye complementary to the dye to be color generated to a high density, it is necessary for an exposure dynamic range of the photosensitive material in which the color generation density of the dye-forming layer cannot be stably controlled at or below the visual threshold by modulation control of the exposure quantity of the light source, that is, the color generation density varies beyond the visual threshold, for example, a low exposure quantity range (low density color generation range), that the spectral sensitivity of photosensitive elements of the photosensitive material and/or the wavelength of the light beam emitted from the light source be adjusted such that said dye-forming layer or dye may be color generated by the other light beam to which another dye-forming layer exhibits maximum sensitivity. More specifically, it is necessary in the practice of the invention that a change in the color generation density of the maximum sensitivity emulsion layer with respect to a change of a minimum unit of modulation control of the exposure quantity of the light source, that is, a density difference be at or below the visual threshold. Although the visual threshold density ($D_v$) is generally 0.01, a smaller value of 0.005 is preferred as the visual threshold density in the event of reproducing a high quality image in which delicate shades in a reddish image having a high degree of saturation are depicted, as encountered in reproducing a crimson rose or red velvet dress with shades.

The color image exposure system used in the image forming process of the invention is now described. One typical example is described in conjunction with the drawings in which one of C, M and Y dye-forming layers in the photosensitive material is color generated at maximum sensitivity with a laser diode used as the light source.

Figure 2:
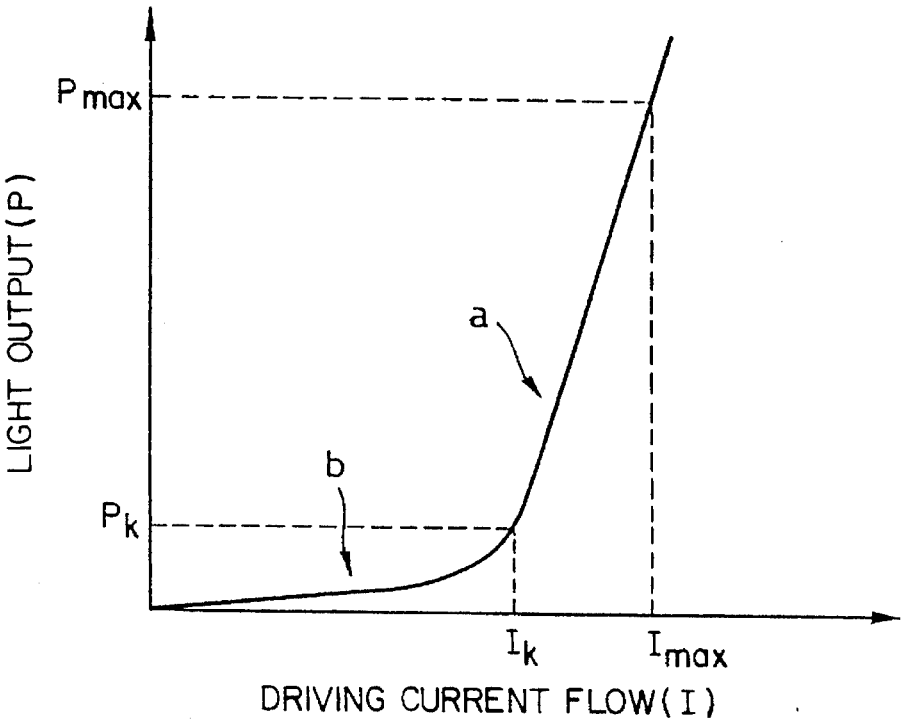
FIG. 2 is a graph showing the light output curve of one exemplary light source used in the image forming process of the invention.

The photosensitive material used herein includes one example in which the photosensitive layer exhibiting maximum sensitivity is that showing an exposure quantity (logE) versus color generation density (D) profile (or sensitivity profile) as shown by the curve in FIG. 1. For brevity of description only, assume that the photosensitive layers (or dye-forming layers) exhibiting maximum sensitivity for C, M and Y of the photosensitive material have an identical sensitivity profile with a characteristic gamma value $\gamma$ and an average gamma value $\gamma_0$. It is further assumed that in a high density range of one color, that is, a high exposure quantity range, this photosensitive material has low density color generation of another color complementary to the one color added with a gradation as shown by a broken line. This complementary color has a sensitivity profile with an approximate average gamma value $\gamma_{0c}$. On the other hand, the laser diode includes a linear region a in which the light output (P) is linear relative to the driving current flow (I) and another region b in which the light output (P) is not linear relative to the driving current flow (I) as shown in FIG. 2. In the non-linear low light output region b ($P<P_k$, $I<I_k$), the light output is not fully stable, and the laser diode is difficult to control to a correct light output. Then for image exposure using the laser diode, a light output in the stable linear region a rather than in the non-linear region b is utilized. More particularly, exposure in the low exposure quantity range in the dynamic range of the photosensitive material is achieved by conducting pulse width modulation on a light output in the linear region a, for example, and exposure in the high exposure quantity range is achieved by carrying out intensity modulation on a light output in the linear region a, thereby improving the reproducibility of the color generation density of an unstable low exposure quantity, low density region. However, digital exposure using a laser light source has the problem of difficult control in a low exposure quantity range as previously described.

Figure 3:
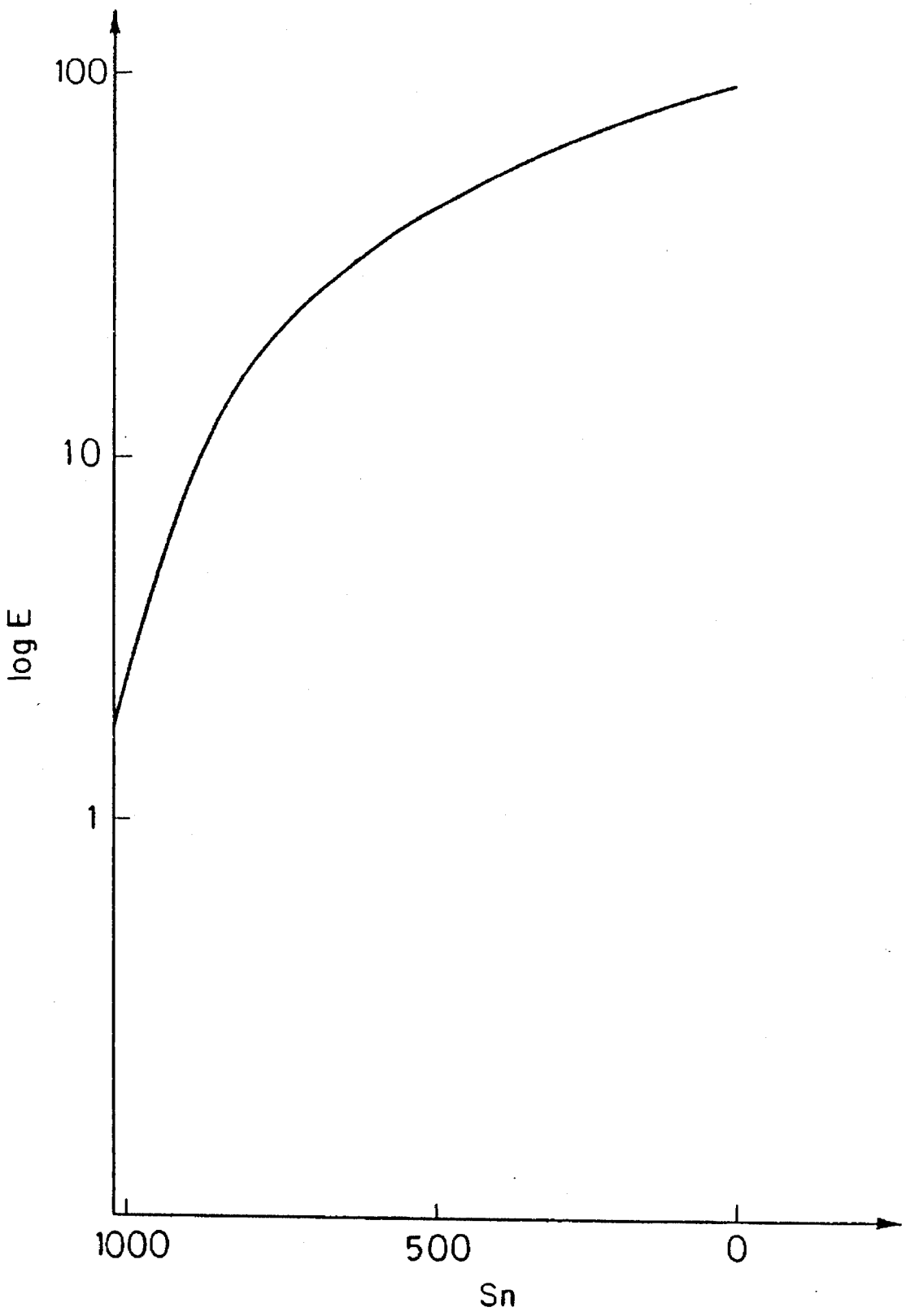
FIG. 3 is a graph showing an exposure quantity relative to a modulation control signal to the light source used in the image forming process of the invention.

When a laser diode as shown in FIG. 2 is modulated in accordance with image data (R, G, B) for the purpose of digital exposure of a photosensitive material as shown in FIG. 1 according to the present invention, a modulation control signal associated for one color with the thus obtained exposure quantity data (C, M, Y), for example, a light output signal in the case of intensity modulation or an exposure time duration signal in the case of pulse width modulation is a digital signal representing one of digital values in a preset definite step. Therefore, these digital modulation control signals S assume anti-logarithmically arithmetic steps and are thus linear relative to the exposure quantity E, but nonlinear relative to the logarithm logE of the exposure quantity E as shown in FIG. 3. It will be understood that FIG. 3 shows, when signals $S_0, S_1, S_2, \ldots, S_n$ (n=1023) of 1024 steps are preset as modulation control signals, a curve representative of the logarithm logE of the exposure quantity signals $E_0, E_1, E_2, \ldots, E_n$ (n=1023) set in correspondence thereto.

Figure 4:
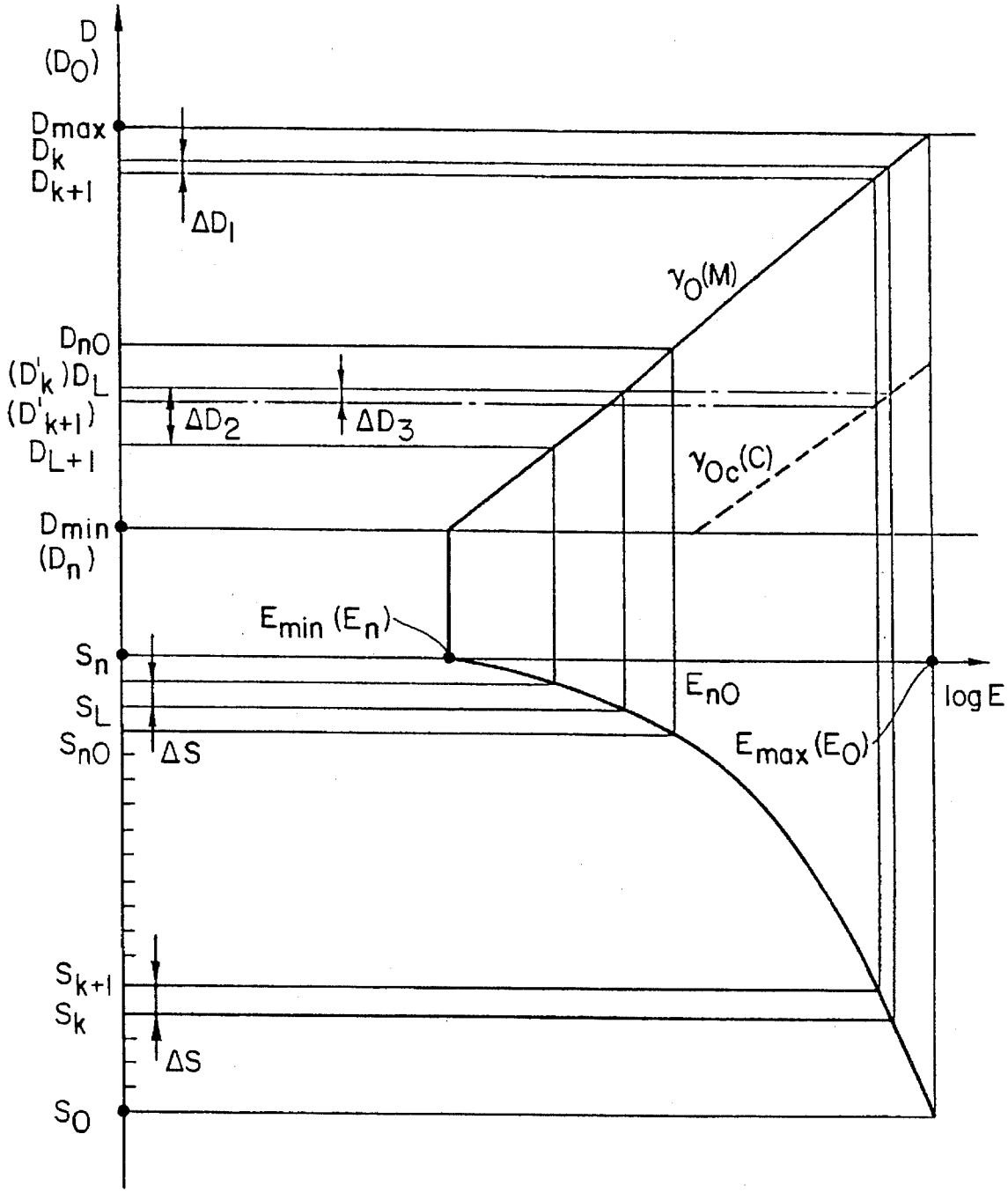
FIG. 4 is a graph showing a reproduction density of a photosensitive material relative to a modulation control signal to the light source used in the image forming process of the invention.

Now combining FIGS. 1 and 3 together provides FIG. 4. As seen from FIG. 4, since the digital modulation control signal S undergoes anti-logarithmic changes and the exposure quantity logE undergoes logarithmic changes, a change $\Delta S$ (the difference between $S_L$ and $S_{L+1}$) in one step of modulation control signal S in a low exposure quantity range and a change $\Delta S$ (the difference between $S_k$ and $S_{k+1}$) in a high exposure quantity range are equal, but a corresponding change $\Delta \log E_2$ ($\log E_L - \log E_{L+1}$) of exposure quantity $\Delta \log E$ is greater than a corresponding change $\Delta \log E_1$ ($\log E_k - \log E_{k+1}$). As a consequence, when a photosensitive material having a sensitivity profile as shown in FIG. 4 is exposed at these exposure quantities for reproduction, a difference $\Delta D_2$ ($D_L - D_{L+}$) in the reproduced density is greater than a difference $\Delta D_1$ ($D_k - D_{k+1}$). And this $\Delta D_2$ is greater than the visual threshold density difference as previously described. Thus, in accordance with the invention, for an exposure quantity range in which $\Delta D$ exceeds the visual threshold density Dv, color generation is effected using another light source, for example, a light source which causes a dye-forming layer complementary to the relevant color to generate its color at maximum sensitivity.

The exposure quantity range in which a certain dye-forming layer does not generate its color at maximum sensitivity upon exposure to single laser light is the range in which the average gamma $\Delta_O$ between the maximum and minimum densities Dmax and Dmin obtained when the photosensitive material is exposed at the maximum and minimum exposure quantities Emax and Emin available from this laser light and exposure quantities $E_0$ ($E_{max}$), $E_1, E_2, E_3, \ldots, E_n$ ($E_{min}$) resulting from modulation control signals $S_0, S_1, S_2, S_3, \ldots, S_n$ numbered from 0 to n in order of decreasing exposure quantity obtained when the laser light is modulated in sequence from the maximum exposure quantity $E_{max}$ to the minimum exposure quantity Emin meet the following relationship.

$$\Delta_0 \cdot \log (E_{n0}/E_{n0+1}) > Dv\ (.005) > \Delta_0 \cdot \log (En_{0-1}/E_{n0})$$

This exposure quantity range corresponds to a modulation control signal S having a greater number nL than the number n0 of the modulation control signal S.

According to the image forming process of the invention, for stably depicting delicate shades in a high density color generated portion of high purity, in the range where the color generation at a low density of a complementary dye required in the color generation at a high density of a certain dye can not be stably accomplished by modulation control of a light source for causing color generation of the complementary dye at maximum sensitivity as shown in FIGS. 1 and 4, color generation is performed by the light source used for the high density color generation. If it is desired to introduce shades in a red color portion of high density, say, introduce shades in a crimson rose as a representative example, then cyan (C) of low density is added to magenta (M) of high density color generation. More particularly, assume that the photosensitive layer having the sensitivity profile with average gamma $\Delta_0$ shown by the solid line in FIG. 4 is a magenta (M) dye-forming layer, which is referred to as a M color-generating layer, hereinafter. Then a cyan (C) dye-forming layer (referred to as a C color-generating layer) complementary to the magenta (M) is represented as the photosensitive layer having the sensitivity profile with average gamma $\gamma_{0c}$ shown by the broken line with respect to the laser diode for emitting laser light having the wavelength for causing color generation of the M color-generating layer at maximum sensitivity, which diode is referred to as a M color-generating LD, hereinafter.

As is evident from FIG. 4, if the modulation control signal S to the M color-generating LD for causing magenta color generation at high density is changed by $\gamma S$ from $S_k$ to $S_{k+1}$, the magenta experiences a change $\Delta D_1$ from the high color generation density $D_k$ to $D_{k+1}$, which $\Delta D_1$ is, of course, below the visual threshold Dr, and the C color-generating layer which generates color at the same time experiences a density change $\Delta D_3$ from the low density $D'_k$ to $D'_{k+1}$. This density change $\Delta D_3$ is significantly smaller than the change $\Delta D_2$ in color generation density of the C color-generating layer relative to the same change ($\Delta S$) of the modulation control signal S to the C color-generating LD upon exposure solely thereby. As a consequence, even if the density difference $\Delta D_2$ is greater than the visual threshold density Dv, the density difference $\Delta D_3$ can be smaller khan the visual threshold density Dv.

Accordingly, the present invention permits sole exposure to the M color-generating LD not only to induce color generation of magenta at a high density, but also to accurately and stably control color generation of cyan at a very low density during the M color generation. By simultaneously carrying out color generation of yellow at the same high density as magenta by sole exposure to a yellow (Y) color-generating LD, delicate shades in a high density color portion like a crimson rose can be accurately and stably depicted.

If it is necessary to enhance the color generation of cyan to a higher density than the color generation density of cyan induced by sole exposure to the M color-generating LD, then additional color generation by the difference is induced by exposure to a C color-generating LD. Since the overall cyan color generation density is off the very low density region for depicting delicate shades, even if the modulation control of the C color-generating LD undergoes a more or less variation and the cyan color generation density is varied by sole exposure to the C color-generating LD, a variation in the overall cyan color generation density is mitigated and becomes less prominent.

There has been described the embodiment wherein for depicting a crimson rose, red velvet dress, red sports car or the like, by sole exposure to a single light source such as a M color-generating LD, not only color generation of magenta (M) of high density is induced, but also cyan (C) of low density is also color generated with a gradation in the high density magenta (M). The present invention is not limited to this particular embodiment, but applicable to any combination to have in a high density color generated portion a complementary color generated at an extremely low density, for example, an embodiment of adding magenta (M) of low density to cyan (C) of high density as required when delicate shades are introduced in high density green as in introducing shades in the deep green of wood or trees as well as an embodiment of adding cyan (C) or magenta (M) of low density to yellow (Y) of high density as required in depicting chrysanthemum petals. Further, in the aforementioned embodiment, there are two color generating layers that can be color generated by sole exposure to a single light source, a color generating layer of maximum sensitivity and a color generating layer of low density. The present invention is not limited thereto, and there can be any desired number of color generating layers of low density. Moreover, the light source which can cause color generation of a plurality of color generating layers by sole exposure thereto is not limited to one, and two or more light sources may be used.

As described above, in the practice of the invention, the spectral sensitivity profile of photosensitive elements in a photosensitive material and/or the wavelength of laser light sources should be adjusted such that when the photosensitive material is exposed solely to the light source which can cause color generation of a plurality of emulsion layers by sole exposure thereto, within the exposure dynamic range of the emulsion layer with the highest sensitivity among a plurality of emulsion layers which have undergone color generation by that exposure, at least one of dyes complementary to the color generating dye corresponding to that photosensitive layer is added with a gradation. Otherwise, for example, unless any complementary color is added within the exposure dynamic range, the reproduction of shades in the resulting image tends to vary.

In the present invention, color generation at low density of a dye (color generating layer) complementary to the color generation at high density upon exposure solely to a single light source (color generation of a color generating layer exhibiting maximum sensitivity) is added in a density region above a predetermined value between 1.5 and 2.5 as expressed by the color generation density of the high density color generating dye while providing a gradation. If the low density color generation of a complementary dye is added in a density region below 1.5 of the color generation density of the high density color generating dye, then turbidity due to color mixing is introduced in the reproduced image, resulting in a lowering of the saturation of a pure color and hence a lowering of image quality. If the low density color generation of a complementary dye is added in a density region above 2.5 of the color generation density, then depiction of shades becomes insufficient.

It is preferred in the practice of the invention to use the aforementioned color development system. The photosensitive material to which the system of forming a dye through color development is applied is preferably one having on a support at least a yellow dye-forming layer, a magenta dye-forming layer and a cyan dye-forming layer, wherein each of the dye-forming layers contains a dye-forming element in the form of a compound capable of forming a dye through coupling reaction with an oxidized form of an aromatic primary amine developing agent, which is generally known as a color coupler.

The color for which shading in high purity, high density color generation is most important is red as previously described. Then the present invention is most effective when low density cyan is added to high density color generation of magenta. Therefore, in an embodiment wherein a dye-forming element in a magenta dye-forming layer in the photosensitive material, that is, a magenta coupler is a compound based on the above-mentioned color development system, that is, capable of forming a magenta dye through coupling reaction, the present invention becomes more effective when, in the absorption spectrum profile of the photosensitive material which is color generated monochromatically with magenta, the color generation hue of the magenta coupler used satisfies the following relationship:

$$K\ (br) \leqq 0.56 \text{ or } K\ (rr) \leqq 0.18$$

where the photosensitive material uses a reflective support, or $$K\ (bt) \leqq 0.44 \text{ or } K\ (rt) \leqq 0.09$$

where the photosensitive material uses a transparent support.

Outside these relationships, the hue of the resulting magenta dye is undesirably turbid to reproduce a reddish color of high purity. If a coupler/dye set suitable for reproducing a reddish color and satisfying these relationships is used, the reproduction of shades in the output image tends to vary to an undesirable extent. This problem can be overcome by adjusting the spectral sensitivity of the photosensitive material and the wavelength of the light source so as to meet the above requirement, whereby improved color reproduction and stable shade reproduction are accomplished at the same time.

Preferably, the magenta coupler contained in the magenta dye-forming layer in the photosensitive material used herein is a compound of general formula (I) defined previously. The use of such a magenta coupler ensures that both a reddish color of high purity and delicate shades are reproduced in a compatible manner by simultaneously achieving high density magenta color generation and low density cyan color generation upon exposure to an identical light source.

Some illustrative, non-limiting examples of the magenta coupler of formula (I) are given below.

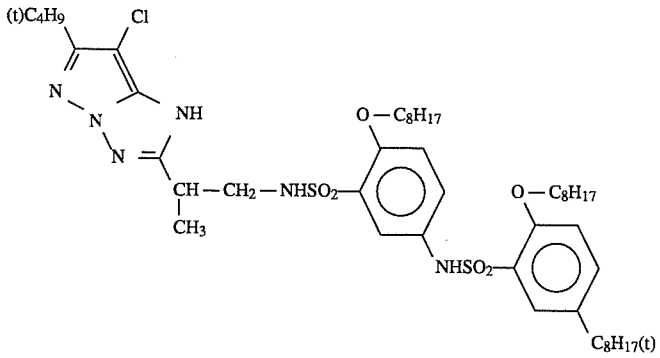
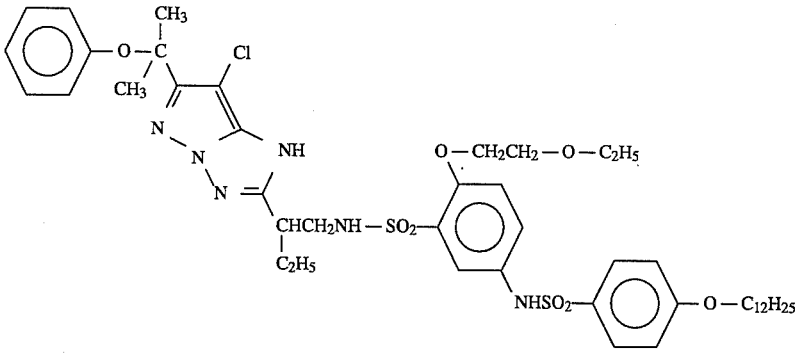
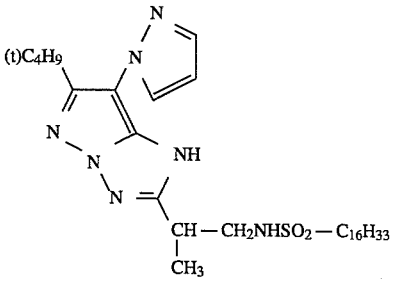
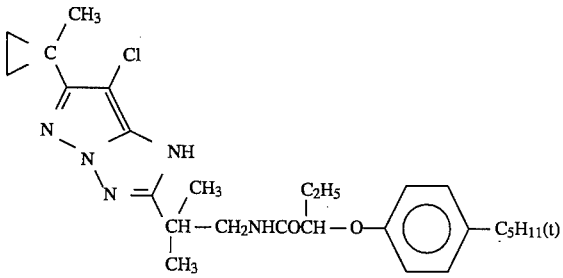
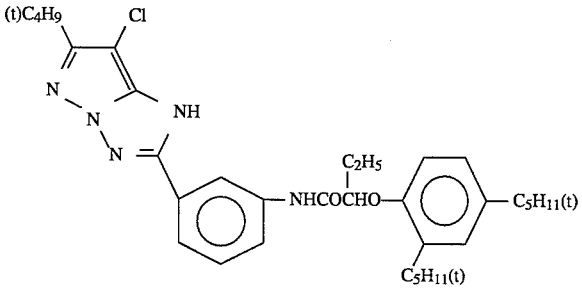

-continued
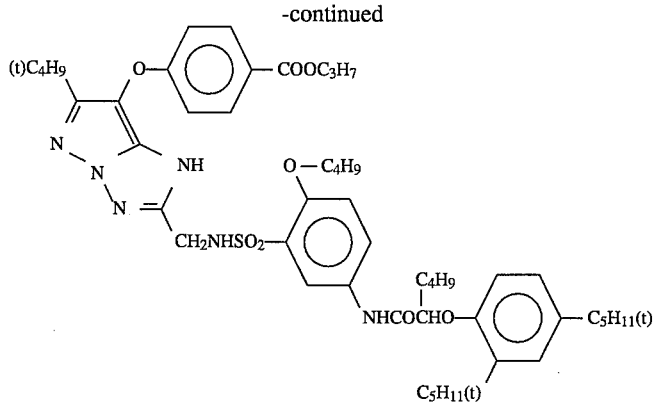
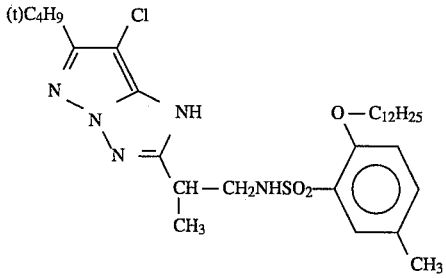
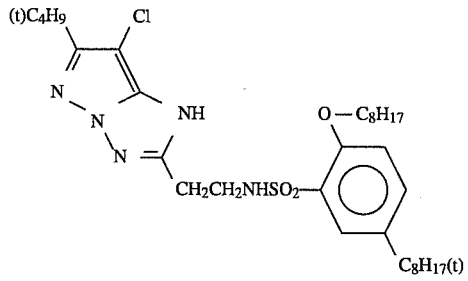
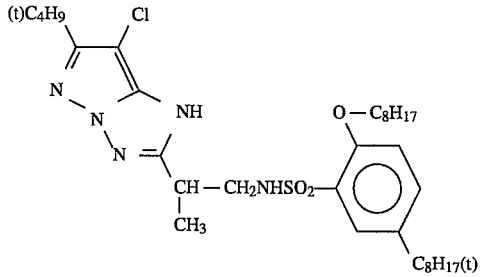
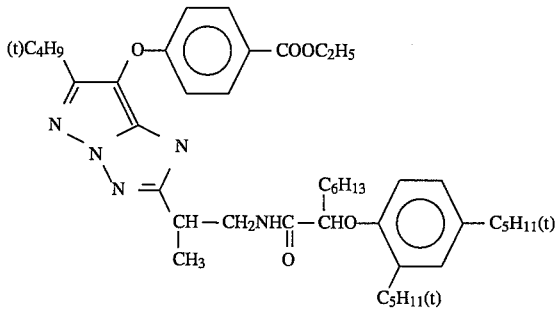
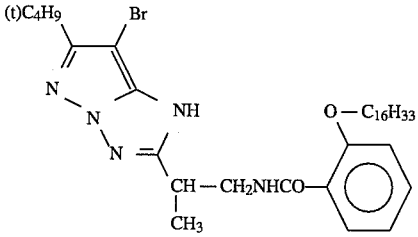
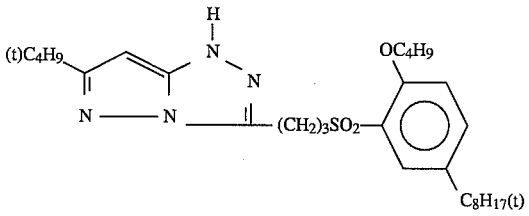

-continued
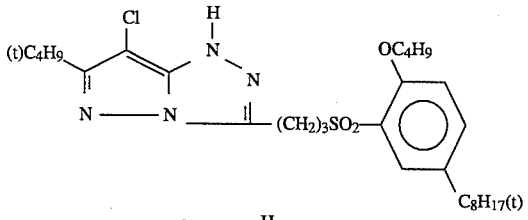
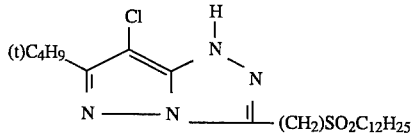
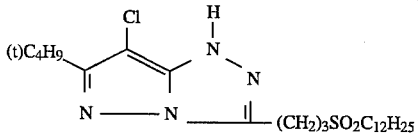
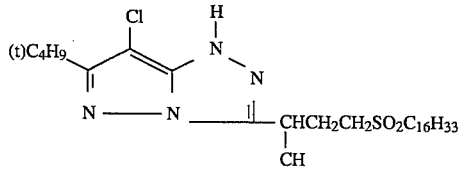
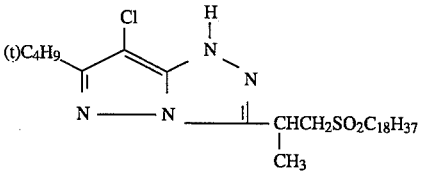
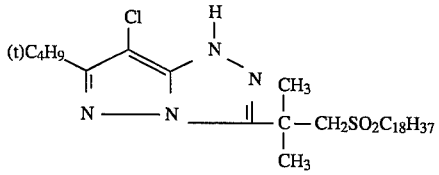
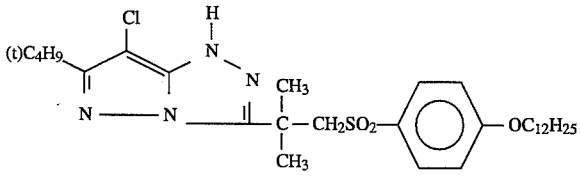
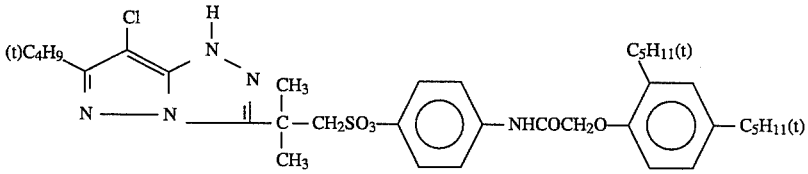
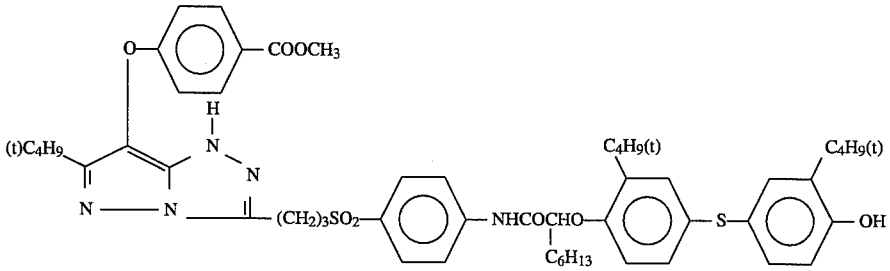
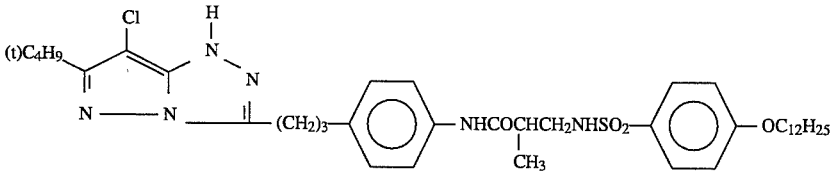
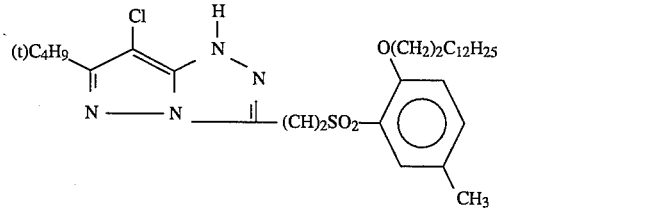

-continued
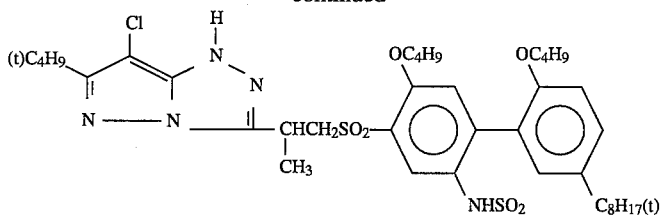
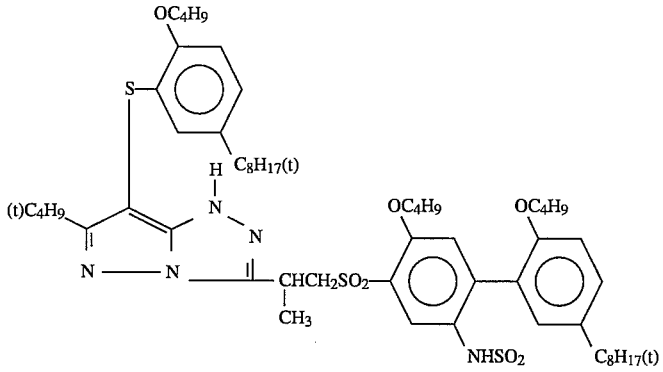
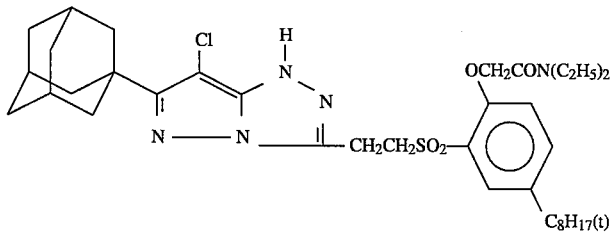
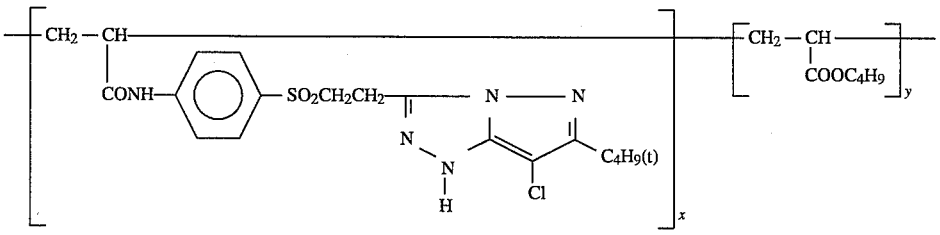
x:y = 50:50
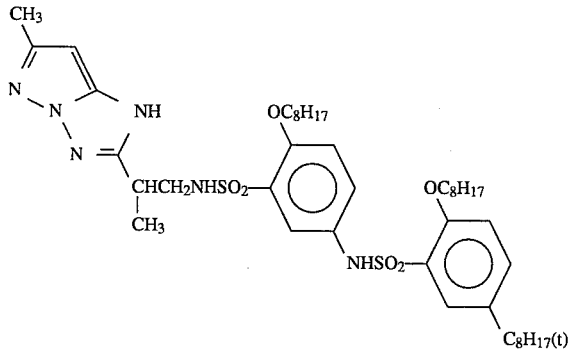

-continued
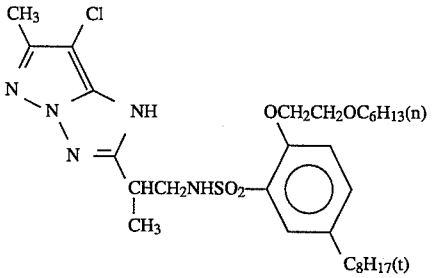
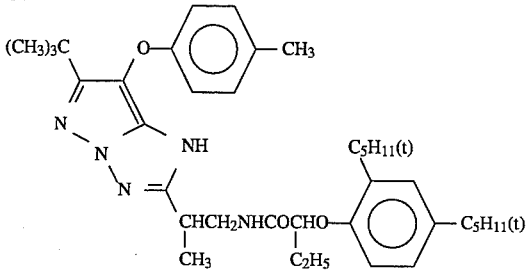
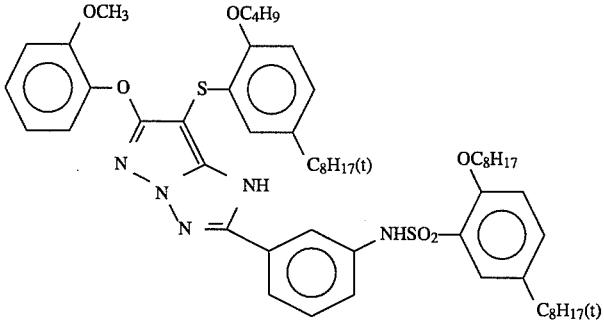
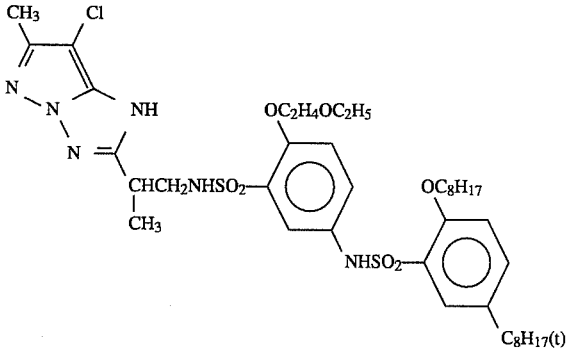
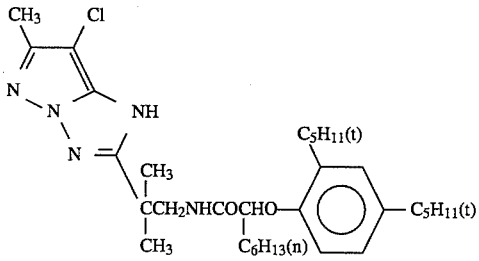
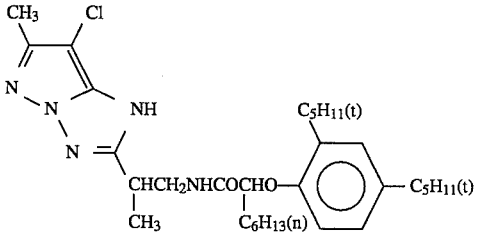
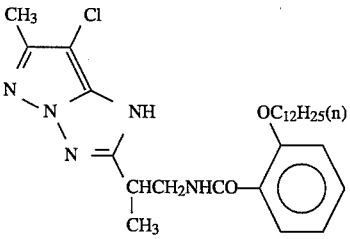
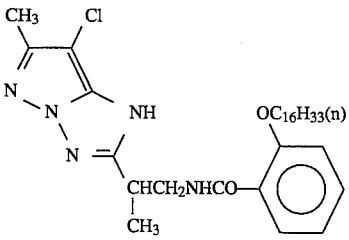

-continued
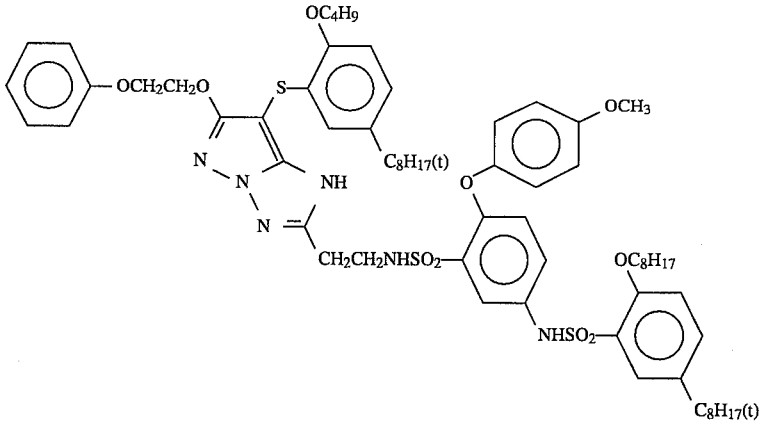
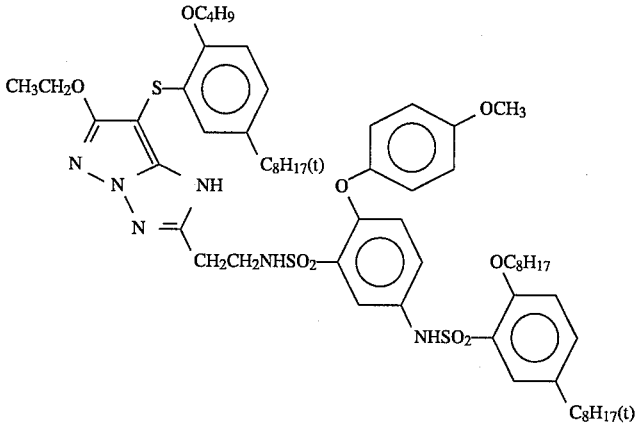
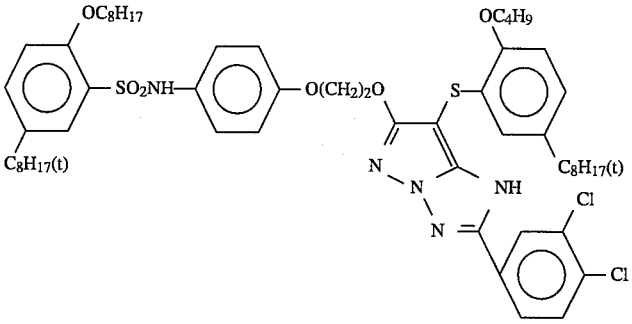
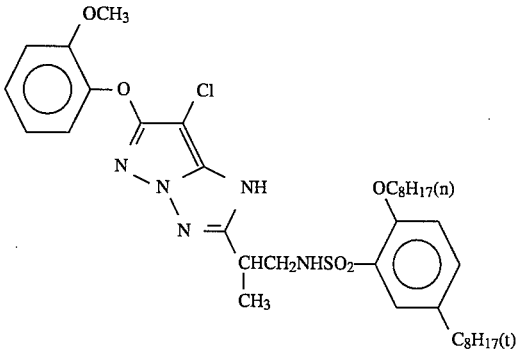

-continued
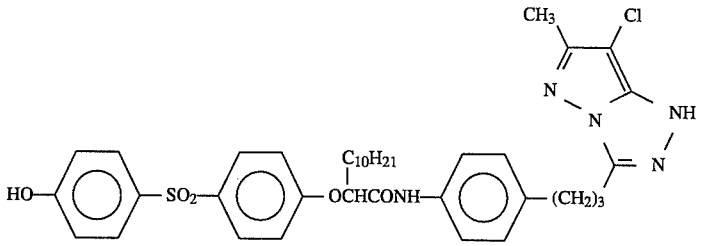
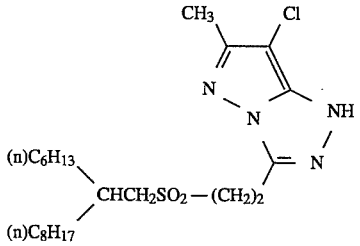
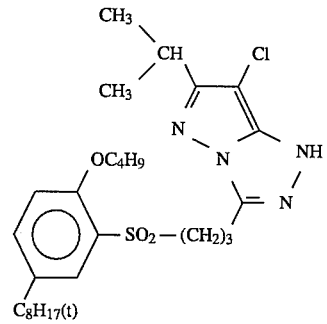
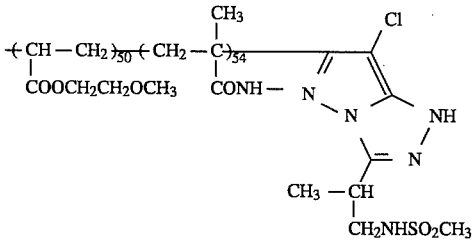
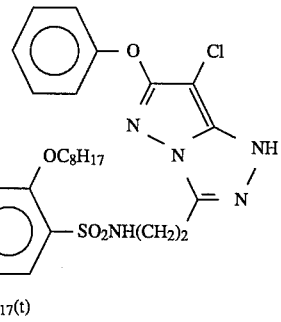
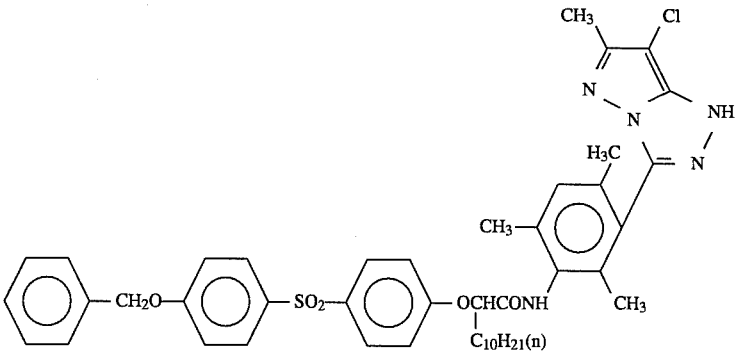
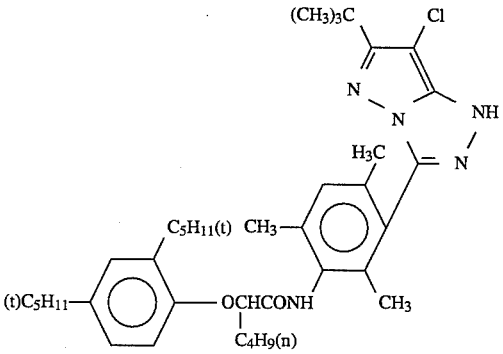

-continued

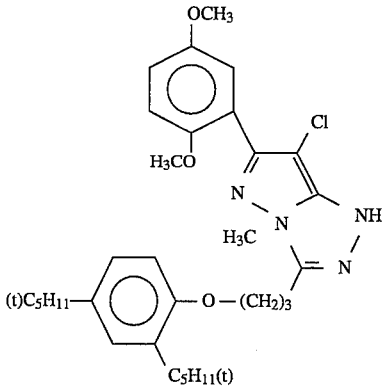

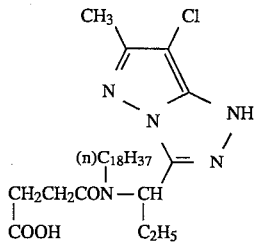

Described below is the further detail of the photosensitive material used herein.

The photosensitive material includes a silver halide emulsion which in one preferred example, contains silver chloride grains having 0.01 to 3 mol% of silver iodide added to the grain surface for the purpose of increasing infrared spectral sensitization sensitivity and stability as disclosed in JP-A 84545/1991. Also preferred are silver chlorobromide and silver chloride grains which are substantially free of silver iodide for providing a shorter development time. The term substantially free of silver iodide means that the silver iodide content is below 1 mol%, especially below 0.2 mol%. The halogen composition of the emulsion may be different among grains although an emulsion of grains having an equal halogen composition is advantageous in that the grains are uniform in nature. As to the halogen composition distribution within silver halide grains, a choice may be made among silver halide grains of the homogeneous structure in which the composition is equal anywhere, silver halide grains of the multi-layer structure in which an interior or core and the surrounding shell (one or more layers) have different halogen compositions, and silver halide grains in which portions of a different halogen composition are present within or at the surface thereof in a non-laminar arrangement (where present at the surface, such different composition portions are joined at the edge, corner and face of grains). The latter two types of grains are advantageous rather than the homogeneous grains for achieving high sensitivity and in view of pressure resistance. Where silver halide grains have such a structure, the interface between portions of different halogen compositions may be either a definite interface or an indefinite interface where mixed crystals are formed due to a compositional difference, or may be intentionally provided with a continuous structural change.

For a photosensitive material adapted for rapid processing, silver halide emulsions having a high silver chloride content are preferred. The high silver halide emulsions preferably have a silver chloride content of higher than 95 mol%, especially higher than 97 mol%.

Among these high silver chloride emulsions, preferred are emulsions of silver halide grains having a localized silver bromide phase disposed in a laminar or non-laminar arrangement within and/or at the surface of the grains. The localized phase may preferably have a silver bromide content of more than 10 mol%, especially more than 20 mol%. The localized phase may be present within grains or at the surface of grains, especially at the edge, corner or face thereof. One preferred example is grains having such a localized phase epitaxially grown at the corner thereof.

It is also effective to further increase the silver halide content of a silver halide emulsion for the purpose of reducing the replenishment of a developer solution. Then emulsions of substantially pure silver chloride grains as having a silver chloride content of 98 to 100 mol% may be used.

Preferably, the silver halide grains in the silver halide emulsion used herein have a mean grain size (a number average of the diameters of circles equivalent to the projected area of grains) of about 0.1 to 2 μm.

The preferred grain size distribution is monodisperse as represented by a coefficient of variation (the standard deviation of the grain size distribution divided by the mean grain size) of up to 20%, especially up to 15%. It is preferred to blend such monodisperse emulsions in a single layer or coat them in an overlapping manner for providing a wide latitude.

The silver halide grains in the emulsion may have a regular crystal shape such as cubic, octahedral and tetradecahedral (14-sided), an irregular crystal shape such as spherical and plate, or a combined shape thereof. Mixtures of various crystal shape grains are also useful. The preferred grains should contain at least 50%, more preferably at least 70%, most preferably at lest 90% of regular crystal shape grains.

Also preferred are emulsions containing plate grains having an average aspect ratio (equivalent spherical diameter/thickness) of at least 5, especially at least 8 in an amount of 50% or more calculated in terms of the projected area.

The silver halide emulsion used herein may be prepared by any of well-known methods as described in P. Glafkides, "Chimie et Phisique Photographique", Paul Montel (1967), G. F. Duffin, "Photographic Emulsion Chemistry", Focal Press (1966), V. L. Zelikman et al., "Making and Coating Photographic Emulsion", Focal Press (1964). More particularly, any of acidic, neutral and ammoniacal methods may be used. The mode of reacting a soluble silver salt with a soluble halide may be single jet mixing, double jet mixing or a combination thereof. It is also employable to form grains in the presence of excess silver ion, which is known as a reverse mixing method. One special type of the double jet technique is by maintaining constant the pAg of a liquid phase in which silver halide is created, which is known as a controlled double jet technique. This method produces a silver halide emulsion having a regular crystal shape and an approximately uniform grain size.

Preferably a heterogeneous metal ion or a complex ion thereof may be contained in the localized phase or base of silver halide grains. Primarily in the localized phase, a metal ion selected from iridium, rhodium and iron or a complex ion thereof may be present. Primarily in the base, a metal ion selected from osmium, iridium, rhodium, platinum, ruthenium, palladium, cobalt, nickel and iron or a complex ion thereof may be present. It is also possible to incorporate different types of metal ion in the localized phase and the base at different concentrations. A mixture of such metals may also be used. Additional useful metal ions include cadmium, zinc, lead, mercury and thallium.

The silver halide emulsion used in the photosensitive material adapted for scanning exposure by a laser or the like is required to have a sufficient gradation to accommodate high illuminance exposure and to provide a necessary density in the exposure control range of the laser. Further where an infrared semiconductor laser is used, the emulsion should be subject to infrared spectral sensitization and improved in shelf stability. For these purposes, it is effective to use a iridium, rhodium, ruthenium or iron ion or a complexion thereof among the above-mentioned metal ions. These metal ions or complex ions may be used in an amount of $5\times10^{-9}$ to $1\times10^{-4}$ mol per mol of silver in the case of iridium and rhodium ions and $1\times10^{-7}$ to $5\times10^{-3}$ mol per mol of silver in the case of iron ion although the amount widely varies with the silver halide emulsion composition, size and doping site of the base to be doped.

These metal ions may be incorporated in the localized phase and/or the remaining portion (base) or silver halide grains, for example, by adding metal ion-providing compounds to a gelatin aqueous solution, silver halide aqueous solution, silver salt aqueous solution or other aqueous solution serving as a dispersing medium during formation of silver halide grains or by adding silver halide fine grains having metal ion previously incorporated therein to such a solution for dissolving the grains therein.

In the practice of the invention, the metal ions may be incorporated into emulsion grains before, during or after formation of silver halide grains. The addition stage may be changed depending on the site of grains where the metal ion is to be incorporated.

The silver halide emulsion used herein is generally subject to chemical and spectral sensitization. For chemical sensitization, use may be made of chemical sensitization using chalcogenide sensitizing agents (for example, sulfur sensitization as typified by the addition of unstable sulfur compounds, selenium sensitization by selenium compounds, and tellurium sensitization by tellurium compound), noble metal sensitization as typified by gold sensitization, and reduction sensitization, alone or in any combination. For the compound used in chemical sensitization, a choice may be made among those described in JP-A 215272/1987, pages 18–22.

The emulsion used herein is of the surface latent image type in which latent images are primarily formed at the grain surface.

Various compounds or precursors thereof may be added to the silver halide emulsion used herein for preventing fogging during preparation, shelf storage or photographic processing of photosensitive material or for stabilizing photographic performance. Preferred examples of these compounds are described in JP-A 215272/1987, pages 39–72.

Spectral sensitization is carried out for the purpose of imparting spectral sensitivity in a desired light wavelength region to the emulsion of each of the layers in the photosensitive material according to the present invention. Since it is intended in the invention to use monochromatic high density light as emitted by lasers and LED for exposure, spectral sensitization should match with the wavelength of such light flux. The spectral sensitization matching with the light flux means to carry out spectral sensitization using a sensitizing dye having spectral sensitivity at the wavelength of the light flux, but need not necessarily mean that the maximum sensitivity by spectral sensitization matches with the wavelength of the light flux. From the aspects of sensitivity to the light flux and color separation, it is preferred that the spectral sensitivity maximum wavelength be coincident with the light flux wavelength. However, it is also preferred to have an intentional design that the spectral sensitivity maximum wavelength is not coincident with the light flux wavelength for the purpose of reducing a sensitivity variation due to variations in wavelength, intensity or the like as a result of a variation of the laser temperature. In the practice of the invention, it is preferred to carry out spectral sensitization on a photosensitive layer other than those photosensitive layers in which the invention is concerned by adding a dye (spectral sensitizing dye) for absorbing light in a wavelength region corresponding to the intended spectral sensitization. The spectral sensitizing dyes used in the spectral sensitization include those described in F. M. Hamer, "Heterocyclic compounds-Cyanine dyes and related compounds", John Wiley & Sons (New York, London), 1964. Exemplary preferred compounds and procedures for spectral sensitization are described in JP-A 215272/1987, pages 22–38.

Where a semiconductor laser is used as a light source for digital exposure in the practice of the invention, efficient spectral sensitization in the red to infrared region is necessary. Especially for spectral sensitization in a region of longer than 730 nm, it is preferred to use such sensitizing dyes as described in JP-A 15049/1991, pages 12–21, JP-A 20730/1991, pages 4–15, EPA 04 20 011, pages 4–6, EPA 04 20 012, pages 4–10, EPA 04 43 466, and U.S. Pat. No. 4,975,362. These sensitizing dyes are relatively chemically stable, relatively strongly adsorb to the surface of silver halide grains, and are resistant against desorption by a dispersion of a coexisting coupler or the like. Preferred sensitizing dyes for infrared sensitization are compounds having a reduction potential of more negative than −1.05 V vs SCE, especially more negative than −1.10 V vs SCE. Sensitizing dyes having such a negative reduction potential are advantageous for increasing sensitivity, especially stabilizing sensitivity and latent images.

It is to be noted that the reduction potential may be measured by phase-discriminating second harmonic AC polarography. For example, the working electrode is a dropping mercury electrode, the reference electrode is a saturated calomel electrode, and the counter electrode is platinum. Measurement of reduction potential by the phase-discriminating second harmonic AC voltammetry using a working electrode of platinum is described in J. Lenhard, Journal of Imaging Science, vol. 30 (1986), pages 27–35.

These spectral sensitizing dyes may be introduced in the silver halide emulsion according to the present invention by directly dispersing the dye in the emulsion. It is also possible to dissolve the dye in a solvent such as water, methanol, ethanol, propanol, methyl cellosolve, and 2,2,3,3-tetrafluoropropanol or a mixture thereof and then add the solution to the emulsion. Alternatively, the dye may be added to the emulsion by dissolving the dye in water in the copresence of an acid or base to form an aqueous solution as disclosed in JP-B 23389/1969, 27555/1969 and 22089/1982; by dissolving or dispersing the dye in water in the co-presence of a surfactant to form an aqueous solution or colloidal dispersion which is added to an emulsion as disclosed in U.S. Pat. No. 3,822,135 and 4,006,025; by dissolving the dye in a solvent substantially immiscible with water such as phenoxyethanol and then dispersing in water or hydrophilic colloid to form a dispersion which is added to an emulsion; and by directly dispersing the dye in a hydrophilic colloid to form a dispersion which is added to an emulsion as disclosed in JP-A 102733/1978 and 105141/1983.

The stage at which the sensitizing dye is added to the silver halide emulsion may be any stage of emulsion preparation which has been recognized to be significant for spectral sensitization. More particularly, the dye may be added at any stages including before grain formation for a silver halide emulsion, during grain formation, from immediately after grain formation to prior to a water washing step, before chemical sensitization, during chemical sensitization, from immediately after chemical sensitization to cooling and solidification of an emulsion, and during preparation of a coating solution. Most often, the dye is added after the completion of chemical sensitization and before coating. It may be added at the same time as a chemical sensitizer to carry out spectral sensitization and chemical sensitization simultaneously as disclosed in U.S. Pat. Nos. 3,628,969 and 4,225,666; or before chemical sensitization as disclosed in JP-A 113928/1983; or well before to start spectral sensitization before the completion of silver halide grain precipitation. Furthermore, as disclosed in U.S. Pat. No. 4,225,666, a spectral sensitizing dye may be added in divided portions during different steps, for example, one portion prior to chemical sensitization and the remainder after chemical sensitization. The dye may be added at any stage during silver halide grain formation as taught by U.S. Pat. No. 4,183,756. Preferably, the sensitizing dye is added before water washing of the emulsion or before chemical sensitization.

The spectral sensitizing dye may be added in a varying amount although the preferred amount is from $0.5\times10^{-6}$ to $1.0\times10^{-2}$ mol per mol of silver halide, especially from $1.0\times10^{-6}$ to $5.0\times10^{-3}$ mol per mol of silver halide.

Where sensitizing dyes having spectral sensitization sensitivity in the red to infrared region are desired in the invention, such compounds as described in JP-A 157749/1990, pages 13–22 are useful. The use of these compounds can specifically increase the shelf stability and processing stability of photosensitive material and supersensitization effect. In particular, the use of a mixture of compounds of formulae (IV), (V) and (VI) in this patent gazette is useful. These compounds are used in amounts of $0.5\times10^{-5}$ to $5.0\times10^{-2}$ mol per mol of silver halide, especially from $5.0\times10^{-5}$ to $5.0\times10^{-3}$ mol per mol of silver halide, and the effective working amount is by a factor of 1 to 10,000, especially 2 to 5,000 per mol of the sensitizing dye.

In the practice of the invention, the spectral sensitive region and sensitivity may be regulated by a choice of the type, addition amount and addition method of a sensitizing dye.

Next, the layer arrangement of the photosensitive material used herein is described. The photosensitive material should comprise at least three layers of silver halide emulsion on a support. The photosensitive material is adapted to undergo digital scanning exposure using monochromatic high density light emitted by a gas laser, light emitting diode, semiconductor laser or the like. The use of a semiconductor laser is especially preferred for reducing the size and cost of the system. In order to use such an inexpensive, stable, compact semiconductor laser, at least two layers should preferably have maximum spectral sensitization at wavelengths of 670 nm or longer. This is because currently available, inexpensive, stable semiconductor lasers have only an emission wavelength region falling in the red to infrared region. However, oscillation of semiconductor lasers in the green or blue regions has been acknowledged on the laboratory scale and thus it is fully expected that with a further advance of the semiconductor laser manufacturing technology, such semiconductor lasers will be available in inexpensive stable form. The advent of such semiconductor lasers will mitigate the necessity that at least two layers have maximum spectral sensitization at wavelengths of 670 nm or longer.

For obtaining full color hard copies, the photosensitive material used herein should preferably include at least three silver halide photosensitive layers having different color sensitivities, which preferably contain compounds capable of color generation to yellow, magenta and cyan or providing such dyes, respectively. The three different color sensitivities may be arbitrarily selected in accordance with the wavelengths of the light sources used for digital exposure, with the nearest maximum spectral sensitivities spaced at least 30 nm. The at least three photosensitive layers (λ1, λ2, λ3) having different spectral sensitivity may contain any of color couplers (Y, M, C) without any limit on the relationship between a layer and a color coupler. Then there can be 3×2=6 possible combinations. From the standpoint of the resolving power of human eyes, it is sometimes preferred that the longest wavelength sensitive layer be a yellow color-generating layer. Also no particular limit is imposed on the order of coating these photosensitive layers having at least three different maximum spectral sensitivities from the support side. From the standpoint of rapid processing, it is sometimes preferred that the photosensitive layer containing silver halide grains with the largest mean grain size be the uppermost layer. Further, from the standpoint of sharpness, it is sometimes preferred that the photosensitive layer having spectral sensitivity to the longest wavelength be the uppermost layer. From the standpoint of storage stability of hard copies under light irradiation, it is sometimes preferred that the magenta color-generating layer be the lowermost layer. Therefore, there are 36 possible combinations of three different spectral sensitivities, three color couplers, and layer arrangement. The present invention is effectively applicable to all photosensitive materials of these 36 combinations. Table 1 shows some illustrative exemplary combinations of digital exposure light sources, spectral sensitivity, and color couplers although the invention is not limited thereto.

TABLE 1

| | Light source for digital scanning exposure | | | Photosensitive material's |
|---|---|---|---|---|
| | Light source | Wave-length (nm) | Color genera-tion | spectral sensitivity maximum (nm) |
| 1 | AlGaInAs (670) | 670 | C | 670 |
| | GaAlAs (750) | 750 | Y | 730 |
| | GaAlAs (810) | 810 | M | 810 |
| 2 | AlGaInAs (670) | 670 | Y | 670 |
| | GaAlAs (750) | 750 | M | 750 |
| | GaAlAs (830) | 830 | C | 830 |
| 3 | AlGaInAs (670) | 670 | M | 670 |
| | GaAlAs (750) | 750 | C | 750 |
| | GaAlAs (810) | 810 | Y | 810 |
| 4 | AlGaInAs (670) | 670 | Y | 670 |
| | GaAlAs (780) | 750 | C | 780 |
| | GaAlAs (830) | 830 | M | 840 |
| 5 | AlGaInAs (670) | 670 | C | 670 |
| | GaAlAs (780) | 750 | M | 780 |
| | GaAlAs (880) | 880 | Y | 880 |
| 6 | GaAlAs (780) | 670 | M | 780 |
| | GaAlAs (830) | 750 | Y | 830 |

TABLE 1-continued

| | Light source for digital scanning exposure | | | Photosensitive material's |
|---|---|---|---|---|
| | Light source | Wave-length (nm) | Color genera-tion | spectral sensitivity maximum (nm) |
| | GaAlAs (880) | 880 | C | 880 |
| 7 | AlGaInAs (633) | 670 | Y | 630 |
| | AlGaInAs (680) | 750 | M | 680 |
| | GaAlAs (780) | 780 | C | 780 |
| 8 | GaAs (900) + SHG | 450 | Y | 450 |
| | InGaAs (1200) + SHG | 600 | M | 580 |
| | AlGaInAs (680) | 680 | C | 700 |
| 9 | LED (580) | 580 | C | 580 |
| | LED (670) | 670 | M | 670 |
| | LED (810) | 810 | Y | 810 |

*SHG: second harmonic generator using a non-linear optical element

Exposure is now described. The photosensitive material is subject to digital exposure of the scanning type wherein a high density light beam emitted by a laser or LED is moved relative to the photosensitive material for imagewise exposure. Therefore, the time when the silver halide in the photosensitive material is exposed is the time required to expose a very small area to light. The very small area is generally the minimum unit for controlling a light quantity from each digital data and known as a pixel. Thus the exposure time per pixel varies with the pixel size. the pixel size depends on the pixel density which actually ranges from 50 to 2,000 dpi. The exposure time is defined as the time required to expose a pixel of a size corresponding to a pixel density of 400 dpi. Then the preferred exposure time is up to $10^{-4}$ sec., especially up to $10^{-6}$ sec.

In addition to the dyes mentioned above, the photosensitive material according to the invention includes a hydrophilic colloid layer which may contain dyes (e.g., oxonol and cyanine dyes) which can be discolored on processing as described in EP 03 37 490 A2, pages 27–76, for the purpose of improving the safety to safe light. Careful attention must be paid to the amount of these dyes used since increased amounts detract from color separation. Further it is preferred to choose among these dyes a dye having absorption overlapping the spectral sensitivity maximum of the longest wavelength sensitive layer. For increased sharpness, these dyes are combined with the dyes according to the present invention such that the photosensitive material may have an optical density of at least 0.5 at the laser wavelength, the optical density being the logarithm of the inverse of transmittance and replaced by a reflection density in the case of a reflective support. For further improving sharpness, a water resistant resin layer in the support may contain at least 12% by weight, more preferably at least 14% by weight of titanium oxide surface treated with a dihydric to tetrahydric alcohol (e.g., trimethylol ethane). It is also preferred to use colloidal silver in an anti-halation layer as disclosed in JP-A 239544/1989.

In the photosensitive material of the color development type according to the invention, compounds for improving color image storage stability as disclosed in EP 02 77 589 A2 are preferably used along with couplers, especially pyrazoloazole couplers. That is, a compound (F) which chemically bonds with an aromatic amine developing agent retained after color development to form a chemically inactive, substantially colorless compound and a compound (G) which chemically bonds with an oxidant of an aromatic amine developing agent retained after color development to form a chemically inactive, substantially colorless compound is used alone or in combination. Use of such compounds is effective for preventing stain and other side effects due to formation of color developing substances through reaction of the coupler with a color developing agent or an oxidant thereof retained in the film during storage after development process.

Further, antibacterial agents as disclosed in JP-A 271247/1988 are preferably added to the photosensitive material according to the invention for controlling propagation of bacteria and fungi in the hydrophilic colloid layer which would otherwise degrade the image.

The support used in the photosensitive material according to the invention may be selected for displays from white polyester supports and those supports having a white pigment-containing layer disposed thereon at the silver halide emulsion layer bearing side. Further, an anti-halation layer is preferably coated on the silver halide emulsion layer bearing side or rear side of the support for improving sharpness. In order that the display can be seen with either reflecting or transmitting light, the support is preferably set to have a transmission density of 0.35 to 0.8.

Also transparent supports are preferably used as the support in the photosensitive material according to the invention. Then an anti-halation layer is preferably coated on the silver halide emulsion layer bearing side or rear side of the support.

The exposed photosensitive material is subject to conventional black-and-white or color development. In the latter case, color development is preferably followed by bleach-fixation for the purpose of rapid processing. Particularly when a high silver chloride emulsion is used, the blix solution should preferably have pH about 6.5 or lower, especially pH about 6 or lower for promoting desilvering or other purposes.

With respect to the silver halide emulsion, other elements (such as additives), and photographic constructive layers (such as layer arrangement) which are applicable to the photosensitive material according to the invention as well as the processing methods and additives for processing the photosensitive material, reference is preferably made to JP-A 215272/1987, JP-A 33144/1991, and EP 03 55 660 A2 (Japanese Patent Application No. 107011/1989.

| Reference List | | | |
|---|---|---|---|
| Photographic element | JP-A 215272/1987 | JP-A 33144/1990 | EP 03 55 660 A2 |
| Silver halide emulsion | P10/UR/L6-P12/LL/L5<br>P12/LR/L17-P13/UL/L17 | P28/UR/L16-P29/LR/L11<br>P30/L2–5 | P45/L53-P47/L3<br>P47/L20–22 |
| Silver halide solvent | P12/LL/L6–14<br>P13/UL/L18-P18/LL/L20 | — | — |
| Chemical sensitizer | P12/LL/L18-LR/L16<br>P18/LR/L1-P22/UR/LJ2 | P29/LR/L12–20 | P47/L4–9 |

-continued

| Photographic element | Reference List JP-A 215272/1987 | JP-A 33144/1990 | EP 03 55 660 A2 |
|---|---|---|---|
| Spectral sensitizer (spectral sensitization) | P22/UR/L13-P38 | P30/UL/L1–13 | P47/L10–15 |
| Emulsion stabilizer | P39/UL/L1-P72/UR/L20 | P30/UL/L14-UR/L1 | P47/L16–19 |
| Development promoter | P72/LL/L1-P91/UR/L3 | — | — |
| Color coupler (cyan, magenta yellow couplers) | P91/UR/L4-P121/LL/L6 | P3/UR/L14-P18/UL/L20<br>P30/UR/L6-P35/LR/L11 | P4/L15–27<br>P5/L30-P28<br>P45/L29–31<br>P47/L23-P63/L50 |
| Color enhancer | P121/UL/L7-PJ25/UR/L1 | — | — |
| UV absorber | P125/UR/L2-P127/LL/L20 | P37/LR/L14-P38/UL/L11 | P65/L22–31 |
| Anti-fading agent (image stabilizer) | P127/LR/L1-P137/LL/L8 | P36/UR/L12-P37/UL/L19 | P4/L30-P5/L23<br>P29/L1-P45/L25<br>P45/L33–40<br>P65/L2–21 |
| High- and low-boiling organic solvents | P137/LL/L9-P144/UR/L20 | P35/LR/L14-P36/UL/L17 | P64/L1–51 |
| Dispersing method of photographic additives | P144/LL/L1-P146/UR/L7 | P27/LR/L10-P28/UL/L20<br>P35/LR/L12-P36/UR/L7 | P63/L51-P64/L56 |
| Hardener | P146/UR/L8-P155/LL/L4 | — | — |
| Developing agent precursor | P155/LL/L5-P155/LR/L2 | — | — |
| Developing-inhibitor releasing compound | P155/LR/L3–9 | — | — |
| Support | P155/LR/L19-P156/UL/L14 | P38/UR/L18-P39/UL/L3 | P66/L29-P67/L13 |
| Photosensitive material layer arrangement | P156/UL/L15-P156/LR/L14 | P28/UR/L1–15 | P45/L41–52 |
| Dye | P156/LR/L15-PJ84/LR/L20 | P38/UL/L12-UR/L7 | P66/L18–22 |
| Anti-color-mixing agent | P185/UL/L1-P188/LR/L3 | P36/UR/L8–11 | P64/L57-P65/L1 |
| Gradation adjusting agent | P188/LR/L4–8 | — | — |
| Anti-staining agent | P188/LR/L9-P193/LR/L10 | P37/UL/L20-LR/L13 | P65/L32-L66/L17 |
| Surfactant | P201/LL/L1-P210/UR/L20 | P18/UR/L1-P24/LR/L20<br>P27/LL/L11-LR/L9 | |
| Fluorinated compound (antistatic agent, coating aids, lubricant, anti-sticking agent, etc.) | P210/LL/L1-P222/LL/L5 | P25/UL/L1-P27/LR/L9 | — |
| Binder (hydrophilic colloid) | P222/LL/L6-P225/UL/L20 | P38/UR/L8–18 | P66/L23–28 |
| Thickener | P225/UR/L1-P227/UR/L2 | — | — |
| Antistatic agent | P227/UR/L3-P230/UL/L1 | — | — |
| Polymer latex | P230/UL/L2-P239 | — | — |
| Matte agent | P240/UL/L1-P240/UR/L20 | — | — |
| Photographic processing method (processing steps, additives, etc.) | P3/UR/L7-P10/UR/L5 | P39/UL/L4-P42/UL/L20 | P67/L14-P69/L28 |

Note: Reference is expressed by page (P), upper left (UL), upper right (UR), lower left (LL), lowe right (LR) columns, and line (L). For example, P10/UR/L6 is page 10, upper right column, line 6.
Reference to JP-A 215272/1987 includes the amendment of March 16, 1987 attached at the end of this gazette.
As to the color couplers, other useful yellow couplers are those yellow couplers of the shortened wavelength type as described in JP-A 231451/1988, 123047/1988, 241547/1988, 173499/1989, 213648/1989, and 250944/1989.

In addition to the diphenylimidazole cyan couplers described in JP-A 33144/1990, useful cyan couplers include 3-hydroxypyridine cyan couplers described in EP 03 33 185 A2, especially, coupler (42) in the form of a 4-equivalent coupler modified into a 2-equivalent coupler by incorporating a chlorine decoupling radical, couplers (6) and (9) therein and cyclic active methylene cyan couplers described in JP-A 32260/1989, especially couplers 3, 8 and 34 therein.

The color developer which can be used in the practice of the invention generally works at a temperature of about 20° to 50° C., preferably about 30° to 45° C. The preferred developing time is substantially within 20 seconds. The amount of developer replenished is generally about 20 to 600 ml, preferably about 50 to 300 ml, more preferably about 60 to 200 ml, most preferably about 60 to 150 ml per square meter of the photosensitive material although the lesser the better.

The invention is advantageously applicable to rapid processing requiring a developing time within substantially 20 seconds. The developing time within substantially 20 seconds is the time taken from the entry of the photosensitive material into the developer tank to the entry thereof into a subsequent tank including a time for crossover passage between the tanks.

Washing or stabilizing step is preferably carried out at pH 4 to 10, more preferably at pH 5 to 8. The temperature may vary with the application and type of the photosensitive material and is generally about 30° to 45° C., preferably 35° to 42° C. The time is arbitrary although a shorter time is desired for reducing the processing time. Desired is a time of about 10 to 45 seconds, especially about 10 to 40 seconds. The replenishment amount is desirably smaller from the standpoints of running cost, exhausted solution to be discarded, and handling. Preferably, the replenishment amount is about 0.5 to 50 times, more preferably 2 to 15 the carry-over from the preceding bath per unit area of photosensitive material. Differently stated, the replenishment amount is preferably up to 300 ml, more preferably up to 150 ml per square meter of photosensitive material. Replenishment may be either continuous or intermittent.

The liquid used in the washing and/or stabilizing step may be recycled to the preceding step. In one exemplary arrangement, the overflow of washing water in a multi-stage counter-current flow system designed to reduce the amount of washing water is channeled to the preceding bath or bleach-fixing bath to which a bleach-fixing-concentrate is replenished, thereby reducing the amount of exhausted solution to be discarded.

Next comes a drying step. In order to complete an image in a very rapid processing fashion according to the present invention, the drying time is desirably from about 20 to 40 seconds. The drying time may be reduced by properly designing the photosensitive material and the dryer. The drying time reducing means associated with photosensitive material is by reducing the amount of hydrophilic binder such as gelatin to thereby reduce the amount of water introduced into the film. From the standpoint of reducing the amount of water introduced into the film, it is also possible to take up water from the film with squeeze rollers or absorbent fabric immediately after emergence from the washing bath. The means associated with the dryer for quickening drying is, as a matter of course, to increase the temperature or to augment drying air. Further, drying can be accelerated by adjusting the angle of drying air flow to the photosensitive material and modifying the way of removal of air after drying.

One exemplary preferred embodiment of the present invention is illustrated in detail in conjunction with the drawings. The invention is not limited to this embodiment.

Figure 5:
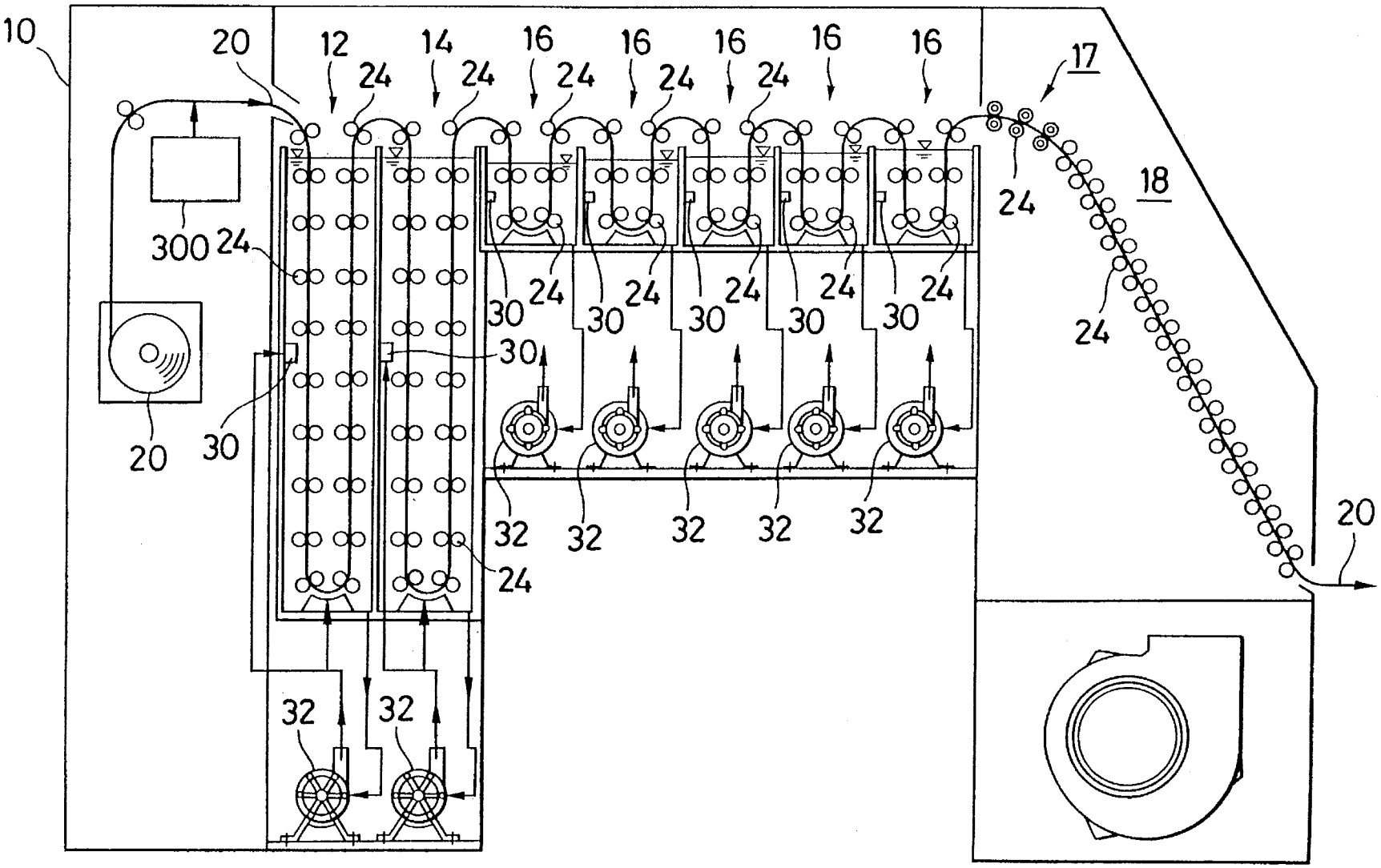
FIG. 5 is a schematic elevational view of one exemplary image forming apparatus used in the invention.

Referring to FIG. 5, there is schematically illustrated an overall image forming apparatus using a silver salt photographic color paper sheet according to the embodiment of the invention. The apparatus is designed to form an image on a color paper through the successive steps of exposure, development, bleach-fixation, washing and drying. The color paper used herein is a color photographic photosensitive material having at least one layer of a silver halide emulsion containing more than 95 mol % of silver chloride on a support, which is color developed with a color developing solution containing an aromatic primary amine color developing agent.

The image forming apparatus generally designated at 10 in FIG. 5 includes an exposure means 300, a developing tank 12, a bleach-fixing tank 14, washing tanks 16, a water removal section 17, and a drying section 18 in a serial arrangement whereby a photosensitive material 20 from a supply roll, after exposure, is successively subject to development, bleach-fixation, washing and drying before it is delivered out of the apparatus. Each of the developing tank 12, bleach-fixing tank 14, washing tanks 16, water removal section 17, and drying section 18 includes plural pairs of conveyor rollers 24 for transporting the photosensitive material 20 forward while clamping it therebetween. The paired conveyor rollers 24 in the water removal section 17 also serve as water take-up rollers for removing water droplets by squeezing or absorbing. The photosensitive material 20 is subject to color development while it is transported through the processing tanks by the paired conveyor rollers, with the emulsion side faced downward, whereby it is immersed in the respective processing solutions for predetermined times. Each of the developing tank 12, bleach-fixing tank 14 and washing tanks 16 is provided with a nozzle 30 for injecting the processing solution into the corresponding tank to create a high velocity jet flow therein. A pump 32 is in flow communication with each of the developing tank 12, bleach-fixing tank 14 and washing tanks 16. The processing solution is pumped by the pump 32 for circulation and injected toward the traveling photosensitive material 20 through the nozzle 30.

Figure 6:
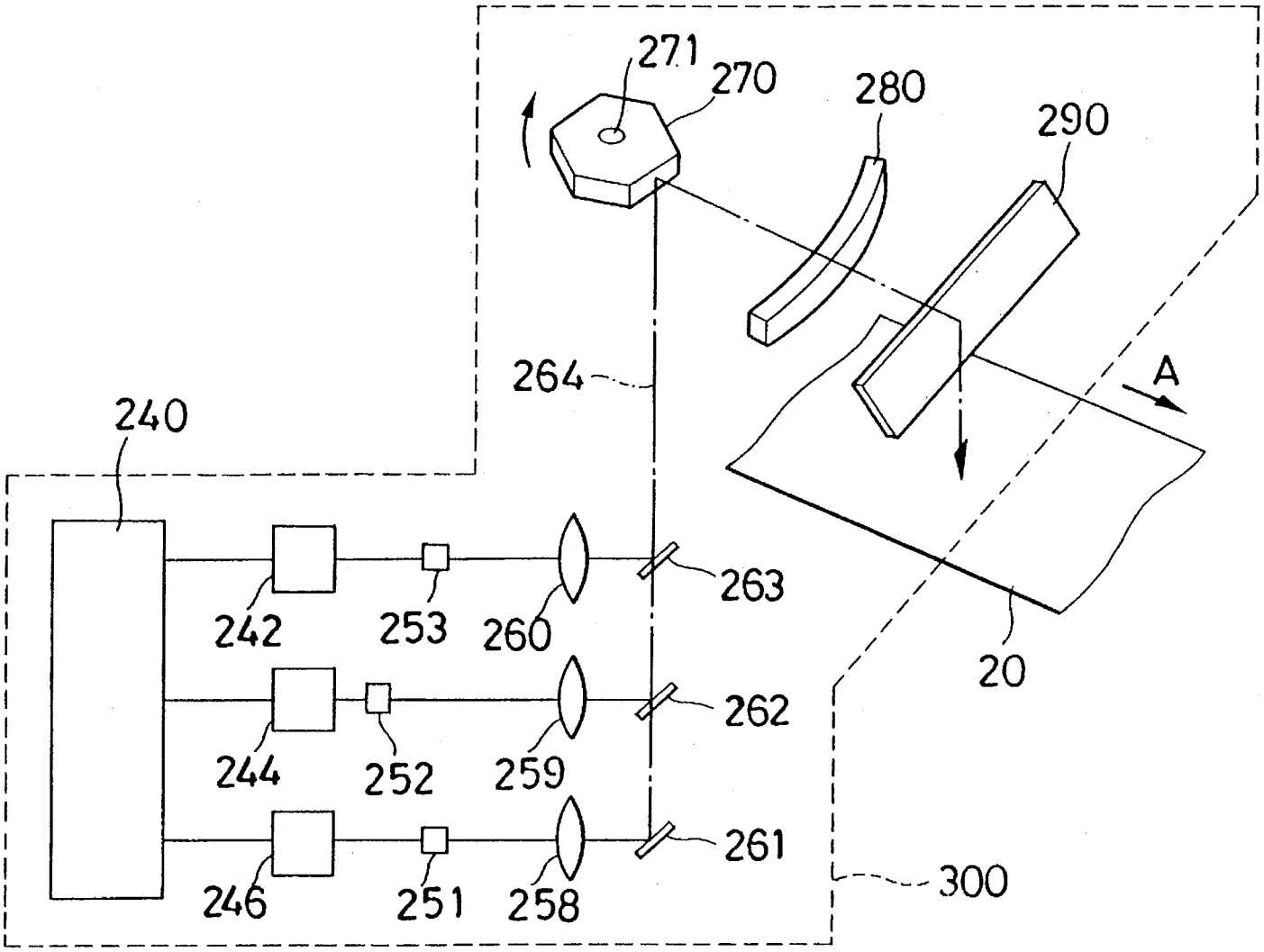
FIG. 6 is a schematic perspective view of one exemplary exposure device in the image forming apparatus of FIG. 5.

FIG. 6 illustrates an exemplary arrangement of the exposure means 300.

The exposure means 300 is designed to emit a set of light beams of three different colors for exposure of the photosensitive material 20. More particularly, the exposure means 300 includes an image processing unit 240 connected to a computer for processing image data and drive circuits 242, 244 and 246 for driving semiconductor lasers 251, 252 and 253 in accordance with the processed image data from unit 240, thereby accomplishing exposure of the photosensitive material 20.

In the exposure means 300, the light for magenta color generation is available from the semiconductor laser 251 for emitting laser light at wavelength 750 nm. The semiconductor laser 251 emits a light beam at wavelength 750 nm which passes through a collimator lens 258 for collimation and is then reflected by a total reflection mirror 261 toward a polygonal mirror 270. This type of semiconductor laser 251 is commercially available as LT030MF from Sharp K.K., for example.

The light for cyan color generation is available from the semiconductor laser 252 for emitting laser light at wavelength 830 nm. The semiconductor laser 252 emits a light beam at wavelength 830 nm which passes through a collimator lens 259 for collimation and is then reflected toward the polygonal mirror 270 by a dichroic mirror 262 for allowing the magenta color generating light to transmit therethrough and reflecting the cyan color generating light. This type of semiconductor laser 252 is commercially available as TOLD152R from Toshiba K.K. and LT010MF from Sharp K.K., for example.

The light for yellow color generation is available from the semiconductor laser 253 for emitting laser light at wavelength 670 nm. The semiconductor laser 253 emits a light beam at wavelength 670 nm which passes through a collimator lens 260 for collimation and is then reflected toward the polygonal mirror 270 by a dichroic mirror 263 for allowing the magenta and cyan color generating light beams to transmit therethrough and reflecting the yellow color generating light. This type of semiconductor laser 253 is commercially available as TOLD9200 from Toshiba K.K., NDL3200 from NEC, and SLD151U from Sony K.K., for example.

The cyan, magenta and yellow color-generating light beams are guided along a common light path 264, reflected by the polygonal mirror 270, passed through a fθ lens 280, and reflected by a mirror 290 before reaching the photosensitive material 20. By rotating the polygonal mirror 270 about its axis 271, the image light is swept over a sector for scanning exposure of the photosensitive material 20. The photosensitive material 20 is moved for subordinate scanning in a direction substantially perpendicular to the scanning direction of the laser light as shown by the arrow A, thereby forming an image. Since the moving speed of the photosensitive material 20 during exposure is equal to the moving speed thereof during the development step, development of any exposed portion of the photosensitive material 20 starts after an equal time from the exposure.

The exposure means 300 is designed to expose the photosensitive material 20 in accordance with the computer or otherwise processed image information. In an alternative embodiment, the image processing unit 240 is connected to an image reader (not shown) so that the photosensitive material 20 may be exposed in accordance with the image information obtained by reading a document.

The image processing unit 240 functions to convert input image signals $R_i$, $G_i$ and $B_i$ of pixel i into output image signals $C_i$, $M_i$ and $Y_i$ of pixel i in accordance with the conversion formula defined by the 3×3 color compensating matrix or three-dimensional interpolation as previously described. The output image signals $C_i$, $M_i$ and $Y_i$ are signals representing the exposure quantities of C, M and Y color-generating LD's for pixel i, respectively, but do not necessarily represent directly the color generation densities of C, M and Y of pixel i, respectively. More particularly, two or more photosensitive layers of the photosensitive material can be color generated by at least one LD according to the present invention. In the event wherein low density color generation of cyan (C) as well as high density color generation of magenta (M) are accomplished by sole exposure by a M color-generating LD, the exposure quantity signal $C_i$ of cyan is zero (dormant) if the entire color generation density of cyan is equal to the color generation density of cyan by that M color-generating LD. If the entire color generation density of cyan is greater than the color generation density of cyan by that M color-generating LD, the exposure quantity signal $C_i$ of cyan corresponds to the exposure quantity required to induce color generation by the difference between these color generation densities. Such signal processing is automatically carried out in the image processing unit 240 by presetting the coefficients of the conversion formula or the elements of the conversion matrix in accordance with the sensitivity profile of the photosensitive material used herein.

EXAMPLE

Examples of the present invention are given below by way of illustration and not by way of limitation.

Example 1

Figure 7:
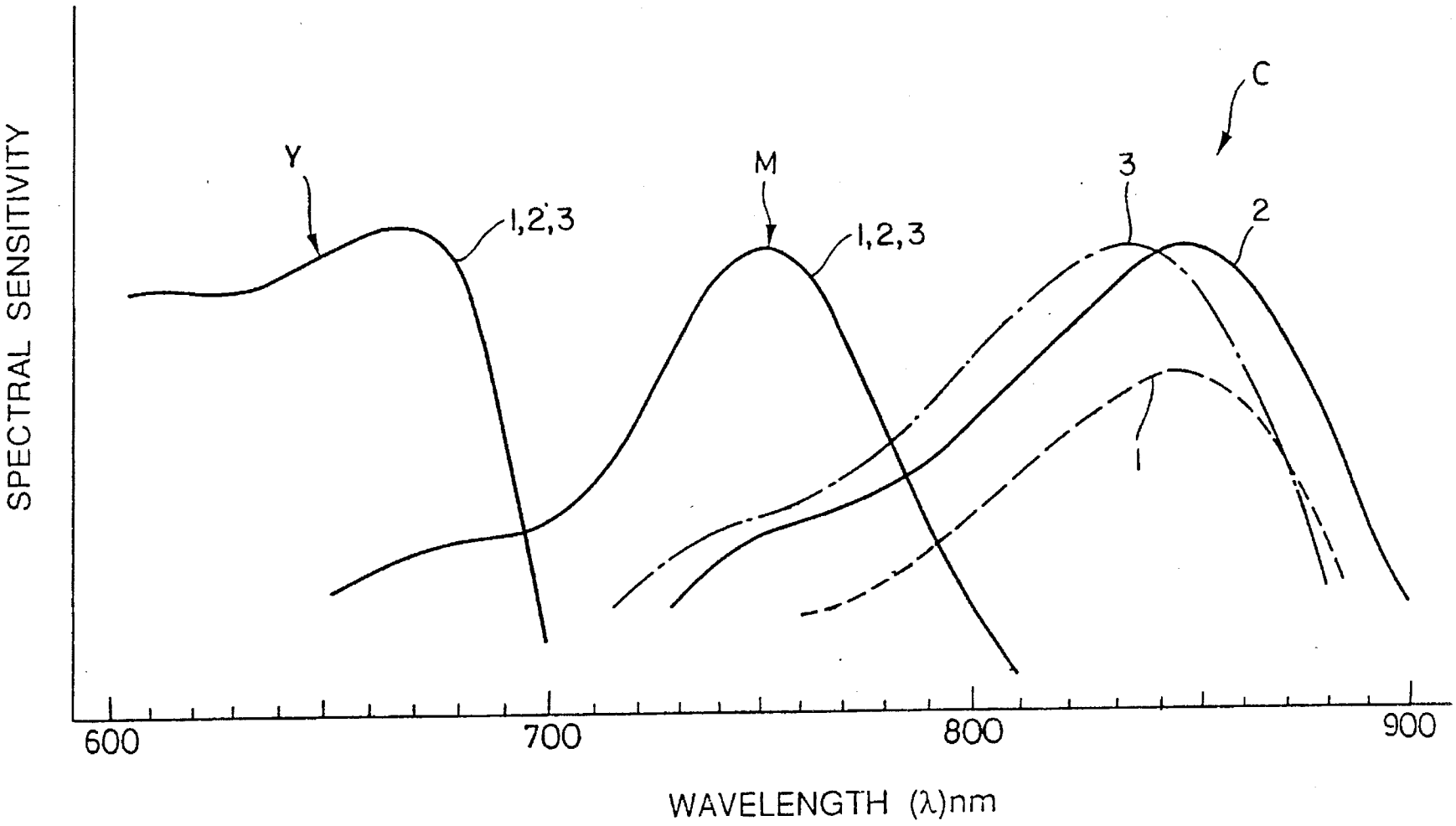
FIGS. 7 and 8 are graphs showing the spectral sensitivity profiles of several photosensitive materials used in Example 1.
Figure 8:
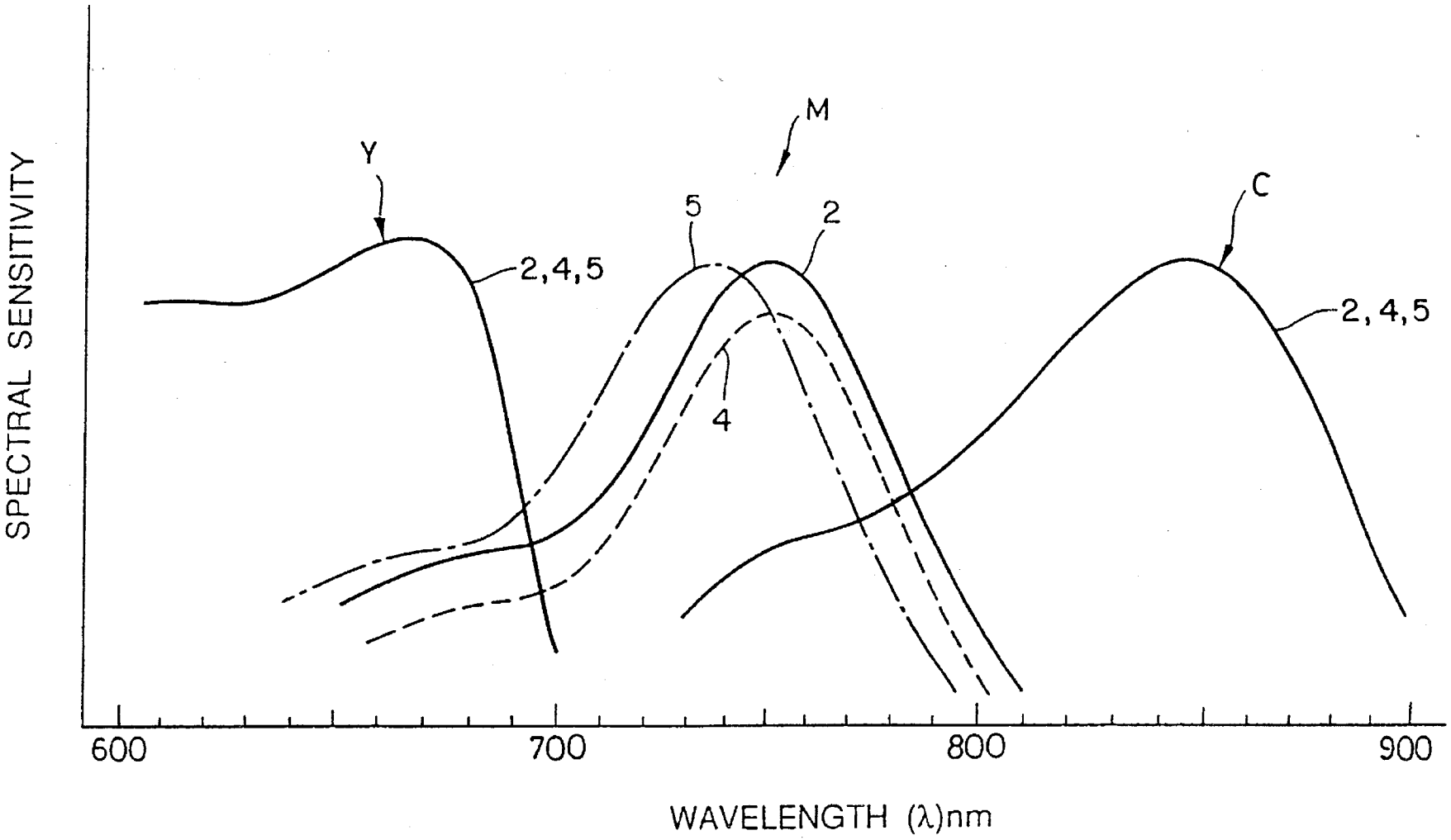

Several photosensitive materials having different spectral sensitivities as shown in FIGS. 7 and 8 were prepared as follows.

Multilayer color photosensitive materials of the combination shown below were prepared by using a silver chlorobromide emulsion chemically sensitized by sulfur sensitization and gold sensitization (containing cubic silver halide grains consisting of 99.2 mol% of silver chloride and 0.8 mol% of silver bromide and having a mean grain size of 0.52 μm with a coefficient of variation of 7.2%) and changing the spectral sensitizing dye.

TABLE 2A

| Sample | No. 1 | No. 2 | No. 3 | No. 4 | No. 5 |
|---|---|---|---|---|---|
| Yellow color generating layer | Dye A $1 \times 10^{-4}$ | Dye A $1 \times 10^{-4}$ | Dye A $1 \times 10^{-4}$ | Dye A $1 \times 10^{-4}$ | Dye A $1 \times 10^{-4}$ |
| Magenta color generating layer | Dye B $5 \times 10^{-5}$ | Dye B $5 \times 10^{-5}$ | Dye B $5 \times 10^{-5}$ | Dye B $3.5 \times 10^{-5}$ | Dye E $5 \times 10^{-5}$ |
| Cyan color generating layer | Dye C $4 \times 10^{-6}$ | Dye C $8 \times 10^{-6}$ | Dye D $6 \times 10^{-6}$ | Dye C $8 \times 10^{-6}$ | Dye C $8 \times 10^{-6}$ |

*unit in mol/mol of Ag

TABLE 2B

| Layer arrangement<br>Support<br>Polyethylene laminated paper (containing $TiO_2$ and a trace of ultramarine in the polyethylene on the first layer side) | |
|---|---|
| First layer (yellow color-generating emulsion layer) | |
| Silver halide emulsion (Table 2A) | 0.25 g/m² of Ag |
| Gelatin | 1.00 g/m² |

TABLE 2B-continued

| Layer arrangement<br>Support<br>Polyethylene laminated paper (containing $TiO_2$ and a trace of ultramarine in the polyethylene on the first layer side) | |
|---|---|
| Yellow coupler (Ex-Y) | 0.70 g/m² |
| Color image stabilizer (Cpd-1) | 0.16 g/m² |
| Color image stabilizer (Cpd-7) | 0.05 g/m² |
| Solvent (Solv-3) | 0.15 g/m² |
| Solvent (Solv-7) | 0.15 g/m² |
| Second layer (color mixing inhibiting layer) | |
| Gelatin | 0.80 g/m² |
| Color mixing inhibitor (Cpd-5) | 0.10 g/m² |
| Solvent (Solv-1) | 0.18 g/m² |
| Solvent (Solv-4) | 0.10 g/m² |
| Third layer (magenta color-generating emulsion layer) | |
| Silver halide emulsion (Table 2A) | 0.17 g/m² of Ag |
| Gelatin | 1.24 g/m² |
| Magenta coupler (Ex-M) | 0.29 g/m² |
| Color image stabilizer (Cpd-3) | 0.12 g/m² |
| Color image stabilizer (Cpd-12) | 0.08 g/m² |
| Solvent (Solv-3) | 0.21 g/m² |
| Solvent (Solv-4) | 0.21 g/m² |
| Solvent (Solv-8) | 0.16 g/m² |
| Fourth layer (UV absorbing layer) | |
| Gelatin | 1.41 g/m² |
| UV absorber (UV-1) | 0.47 g/m² |
| Color mixing inhibitor (Cpd-5) | 0.05 g/m² |
| Solvent (Solv-5) | 0.24 g/m² |
| Fifth layer (cyan color-generating emulsion layer) | |
| Silver halide emulsion (Table 2A) | 0.22 g/m² of Ag |
| Gelatin | 1.00 g/m² |
| Cyan coupler (Ex-C) | 0.32 g/m² |
| Color image stabilizer (Cpd-2) | 0.03 g/m² |
| Color image stabilizer (Cpd-4) | 0.02 g/m² |
| Color image stabilizer (Cpd-6) | 0.18 g/m² |
| Color image stabilizer (Cpd-7) | 0.40 g/m² |
| Color image stabilizer (Cpd-8) | 0.05 g/m² |
| Solvent (Solv-6) | 0.14 g/m² |
| Sixth layer (UV absorbing layer) | |
| Gelatin | 0.48 g/m² |
| UV absorber (UV-1) | 0.16 g/m² |

TABLE 2B-continued

| Layer arrangement<br>Support<br>Polyethylene laminated paper (containing $TiO_2$ and a trace of ultramarine in the polyethylene on the first layer side) | |
|---|---|
| Color mixing inhibitor (Cpd-5) | 0.02 g/m² |
| Solvent (Solv-5) | 0.08 g/m² |
| Seventh layer (protective layer) | |
| Gelatin | 1.00 g/m² |

TABLE 2B-continued

| Layer arrangement<br>Support<br>Polyethylene laminated paper (containing $TiO_2$ and a trace of ultramarine in the polyethylene on the first layer side) | |
|---|---|
| Acryl-modified polymer of polyvinyl alcohol (modification 17%) | 0.16 g/m$^2$ |
| Liquid paraffin | 0.02 g/m$^2$ |

The resulting samples had spectral sensitivity profiles shown in FIGS. 7 and 8.

Images were written in these samples by means of an exposure device using semiconductor lasers having an oscillation wavelength of about 670 nm (AlGaInP), about 750 nm (GaAlAs) and about 830 nm (GaAlAs).

First, the sample was subjected to wedgewise exposure for sensitometry by sole oscillation of a single laser, then to color development as will be described later, and measured for reflection density, from which a characteristic curve was plotted. For the magenta color generated portion, G density was measured as well as R density to determine the magenta density at which color generation of a cyan component complementary to the magenta started. The results are shown in Table 3.

TABLE 3

| Sample No. | Magenta density at the start of cyan color generation |
|---|---|
| 1 | not observed in the dynamic range of magenta color generation |
| 2 | D(M) = 2.33 |
| 3 | D(M) = 2.21 |
| 4 | D(M) = 2.05 |

TABLE 3-continued

| Sample No. | Magenta density at the start of cyan color generation |
|---|---|
| 5 | D(M) = 2.05 |

The next test was to write in the sample pictorial image data recorded as digital signals. The image data used were obtained from a A4-size photographic print of a red sweater wearing woman having a crimson rose by scanner resolution thereof through an aperture of 30 μm. The image data were written in sample Nos. 1 to 5, which were subjected to color development for reproducing the image. For the purpose of examining image reproducibility, the image write-in procedure was continuously repeated 20 times from the start of operation of the exposure device, the apparatus was interrupted for 3 hours, and the procedure was again repeated 20 times. The resulting 40 prints were evaluated for a variation of delicate shades in the rose and sweater. Color matching between the output image and the original image was adjusted at the beginning of the test for each of the photosensitive materials. The results are shown in Table 4.

TABLE 4

| Sample No. | Stability of delicate shades |
|---|---|
| 1 | practically unacceptable large variation |
| 2 | less shade reproduction in 3 of 40 prints |
| 3 | very stable shade reproduction |
| 4 | very stable shade reproduction |
| 5 | very stable shade reproduction |

The image forming process of the invention is effective in stably reproducing delicate shades in an image.

The chemicals used herein are shown below.

Spectral sensitizing dye A:

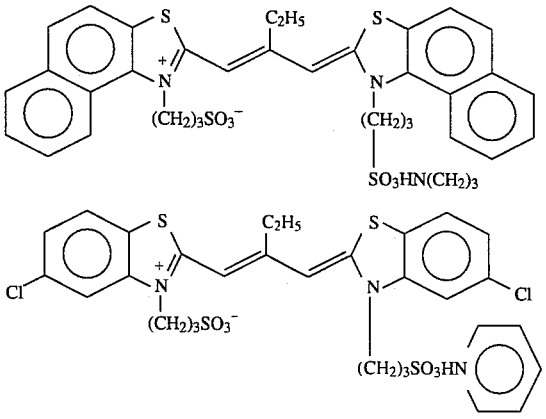

Sensitizing dye B:

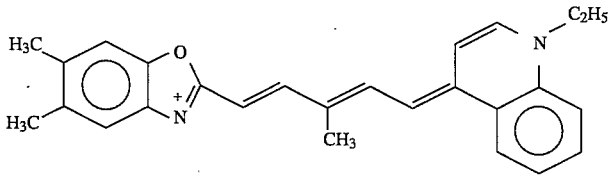

-continued
Sensitizing dye C:
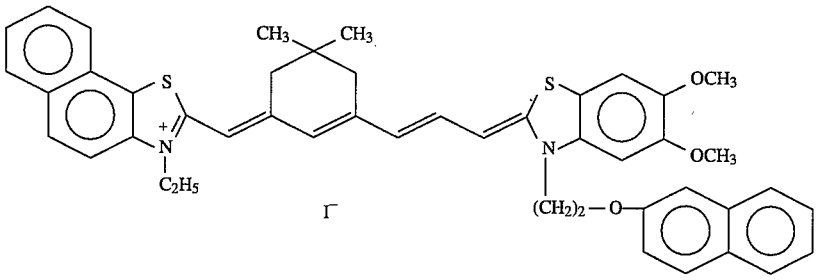
Sensitizing dye D:
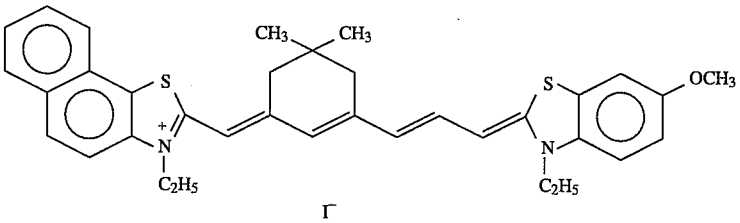
Sensitizing dye E:
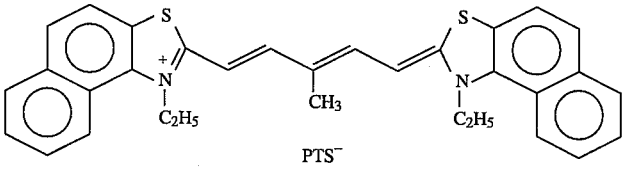
Yellow coupler (ExY):
a 1:1 (molar ratio) mixture of the following two.
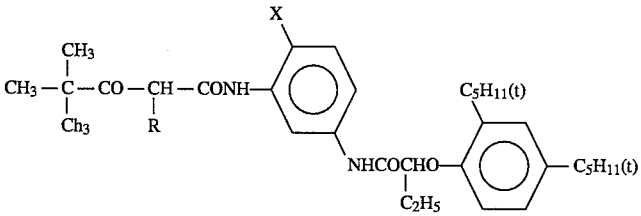
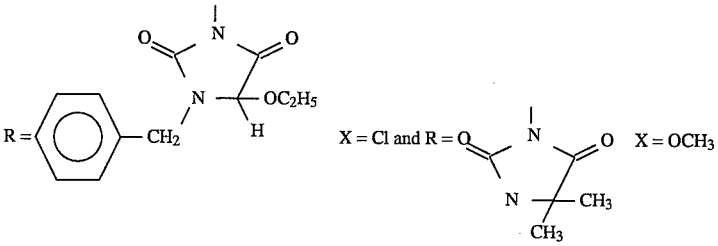
Magenta coupler (ExM):

-continued
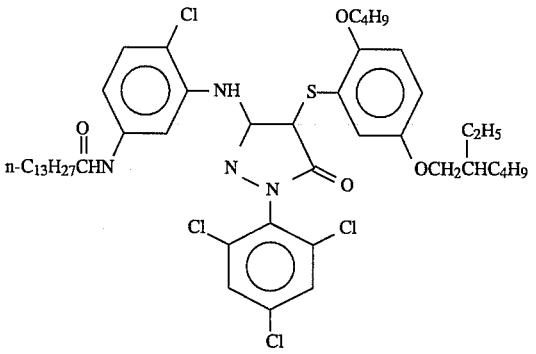
Cyan coupler (ExC):
a 1:1 (molar ratio) mixture of the following two.
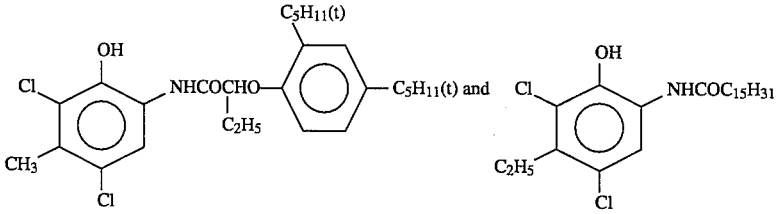
Color image stabilizer (Cpd-1):
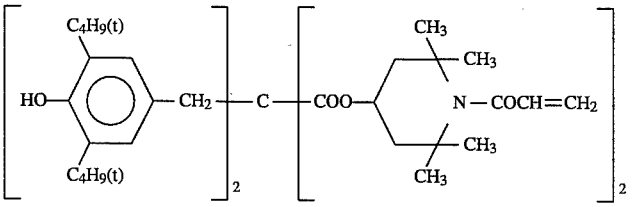
Color image stabilizer (Cpd-2):
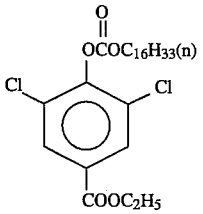
Color image stabilizer (Cpd-3):
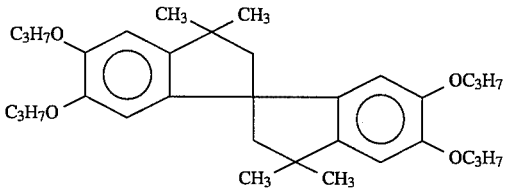
Color image stabilizer (Cpd-4):
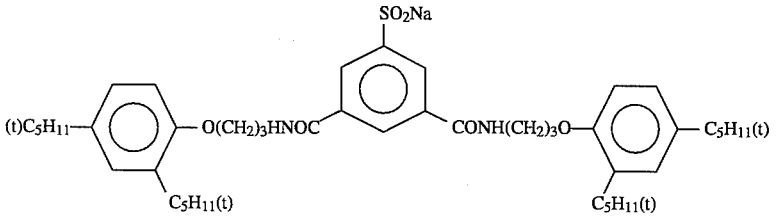

-continued
Color mixing inhibitor (Cpd-5):
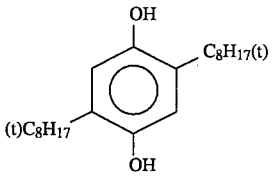
Color image stabilizer (Cpd-6):
a 2:4:4 (weight ratio) mixture of the following three.
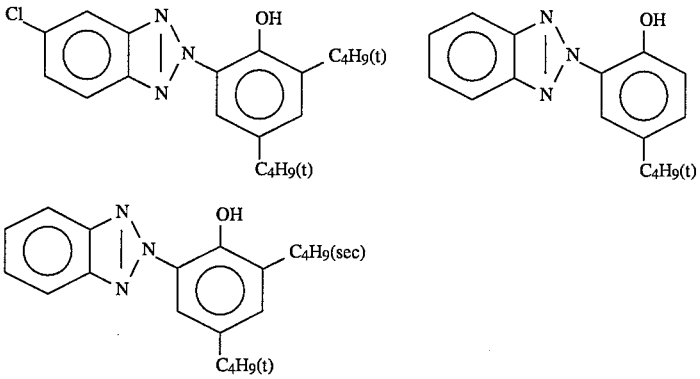
Color image stabilizer (Cpd-7):
$$-\!\!\left(CH_2-\underset{\underset{CONHC_4H_9(t)}{|}}{CH}\right)\!\!-_n$$
average MW: 60,000
Color image stabilizer (Cpd-8):
a 1:1 (weight ratio) mixture of the following two.
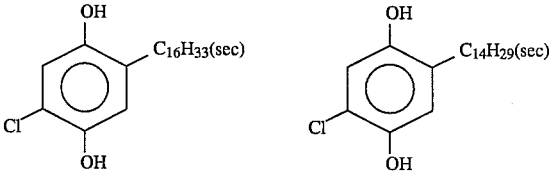
Color image stabilizer (Cpd-9):
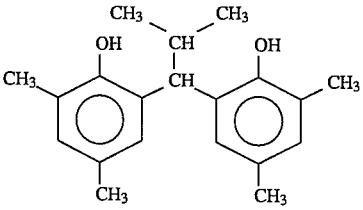
Preservative (Cpd-10):
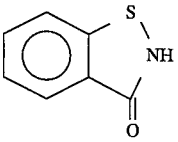
Preservative (Cpd-11):
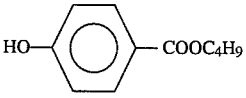

-continued
Color image stabilizer (Cpd-12):
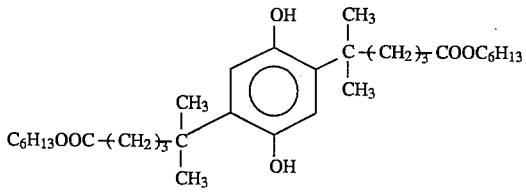
UV absorver (UV-1):
a 4:2:4 (weight ratio) mixture of the following three.
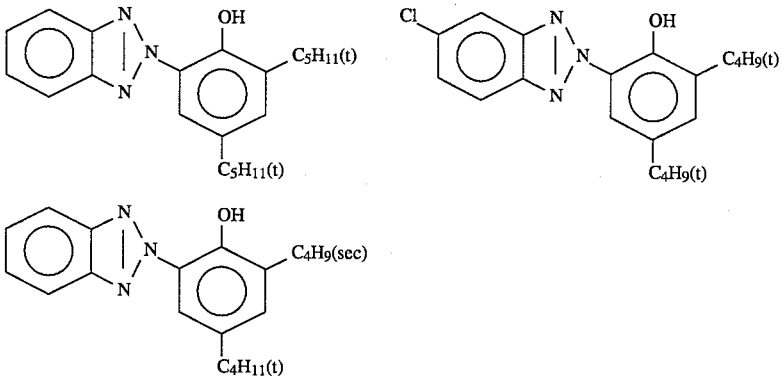
Solvent (Solv-1):
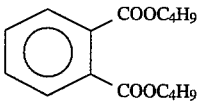
Solvent (Solv-2):
a 1:1 (volume ratio) mixture of the following two.
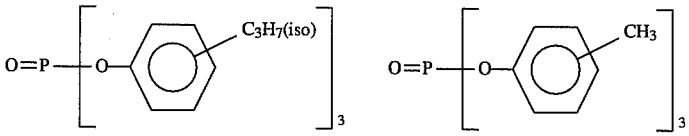
Solvent (Solv-3):
$O{=}P-[O-C_9H_{19}(iso)]_3$
Solvent (Solv-4):
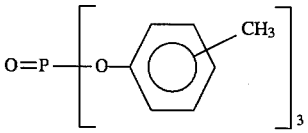
Solvent (Solv-5):
$(COOC_8H_{17})_2(CH_2)_8$
Solvent (Solv-6):
a 80:20 (volume ratio) mixture of the following two.

-continued

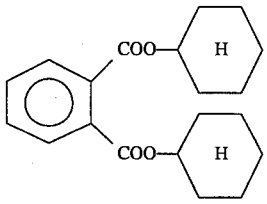

$C_8H_{17}CHCH(CH_2)_7COOC_8H_{17}$
O

Solvent (Solv-7):

$C_8H_{17}CHCH(CH_2)_7COOC_8H_{17}$
O

Solvent (Solv-8):

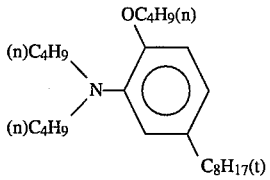

The color development process used herein is given below.

| Step | Temp. | Time | Replenisher | Tank volume |
|---|---|---|---|---|
| Color development | 35° C. | 20" | 60 ml | 2 liter |
| Bleach-fixation | 30–35° C. | 20" | 60 ml | 2 liter |
| Rinsing (1) | 30–35° C. | 10" | — | 1 liter |
| Rinsing (2) | 30–35° C. | 10" | — | 1 liter |
| Rinsing (3) | 30–35° C. | 10" | 120 ml | 1 liter |
| Drying | 70–35° C. | 20" | | |

*Replenishment is per square meter of the photosensitive material
Rinsing water is counterflow from tank (3) to (1).

The processing solutions used herein had the following composition.

| Color developer | Tank | Replenisher |
|---|---|---|
| Water | 800 ml | 800 ml |
| ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 4.9 g | — |
| Potassium carbonate | 25 g | 37 g |
| 4-amino-3-methyl-N-ethyl-N-(3-hydroxypropyl)aniline-2-p-toluenesulfonic acid | 12.8 g | 19.8 g |
| N,N-bis(carboxymethyl)hydrazine | 5.5 g | 7.0 g |
| Brightener (WHITEX 4B, Sumitomo Chemical K.K.) | 1.0 g | 2.0 g |
| Water totaling to | 1000 ml | 1000 ml |
| pH (25° C.) | 10.05 | 10.45 |

| Blix solution (common to tank solution and replenisher) | |
|---|---|
| Water | 400 ml |
| Ammonium thiosulfate (700 g/l) | 100 ml |
| Sodium sulfite | 17 g |
| Ammonium iron (III) EDTA | 55 g |
| Disodium EDTA | 5 g |
| Ammonium bromide | 40 g |
| Water totaling to | 1000 ml |

-continued

| | |
|---|---|
| pH (25° C.) | 6.0 |

Rinse solution (common to tank solution and replenisher)
Ion exchanged water (both Ca and Mg<3 ppm)

Example 2

Using sample Nos. 1, 2 and 3 prepared in Example 1, a test was carried out in accordance with the following exposure method.

| | Exposure method A | Exposure method B |
|---|---|---|
| Semiconductor laser for yellow color-generating layer | 670 nm AlGaInP | 670 nm AlGaInP |
| Semiconductor laser for magenta color-generating layer | 750 nm GaAlAs | 750 nm GaAlAs |
| Semiconductor laser for cyan color-generating layer | 830 nm GaAlAs | 810 nm GaAlAs |

First, the sample was subjected to wedgewise exposure for sensitometry by sole oscillation of the semiconductor laser for cyan color-generating layer in exposure method A, then to color development as in Example 1, and measured for reflection density, from which a characteristic curve was plotted. G density was measured as well as R density to determine the cyan density at which color generation of a magenta component complementary to the cyan started.

This procedure was repeated for oscillation of the semiconductor laser for cyan color-generating layer in exposure method B.

The results are shown in Table 5.

TABLE 5

| Sample No. | Exposure method | Cyan density at the start of magenta color generation |
|---|---|---|
| 1 | A | not observed in the dynamic range of magenta color generation |
| 2 | A | not observed in the dynamic range of magenta color generation |
| 3 | A | not observed in the dynamic range of magenta color generation |
| 1 | B | D(C) = 1.47 |
| 2 | B | D(C) = 2.25 |
| 3 | B | D(C) = 2.42 |

The next test was to write in the sample pictorial image data recorded as digital signals. The image data used were obtained from a A4-size photographic print of a green sweater wearing woman holding a parsley and green pepper-containing basket by scanner resolution thereof through an aperture of 30 μm. The image data were written in sample Nos. 1 to 3 in accordance with exposure methods A and B, which were subjected to color development for reproducing the image. For the purpose of examining image reproducibility, the image write-in procedure was continuously repeated 20 times from the start of operation of the exposure device, the apparatus was interrupted for 3 hours, and the procedure was again repeated 20 times. The resulting 40 prints were evaluated for a variation of delicate shades in the vegetables and sweater. Color matching between the output image and the original image was adjusted at the beginning of the test for each of the photosensitive materials. The results are shown in Table 6.

TABLE 6

| Sample | Exposure method | Stability of delicate shades |
|---|---|---|
| 1 | A | somewhat large variation |
| 2 | A | somewhat large variation |
| 3 | A | somewhat large variation |
| 1 | B | stable shade reproduction, but turbid green |
| 2 | B | very stable shade reproduction |
| 3 | B | insufficient shade reproduction in 2 of 40 prints |

Equivalent results to Example 1 were obtained by adjusting the oscillation wavelength of the laser.

Example 3

Sample Nos. 6 to 10 were prepared in the same manner as sample Nos. 1 to 5 in Example 1 except that the composition of the magenta color-generating layer was changed as follows.

| Third layer (magenta color-generating emulsion layer) | |
|---|---|
| Silver halide emulsion | see Table 2A |
| coverage calculated as Ag | 0.12 g/m$^2$ |
| Gelatin | 1.28 g/m$^2$ |
| Magenta coupler (Ex-M2) | 0.23 g/m$^2$ |
| Color image stabilizer (Cpd-2) | 0.03 g/m$^2$ |
| Color image stabilizer (Cpd-3) | 0.16 g/m$^2$ |
| Color image stabilizer (Cpd-4) | 0.02 g/m$^2$ |
| Color image stabilizer (Cpd-9) | 0.02 g/m$^2$ |
| Solvent (Solv-2) | 0.40 g/m$^2$ |
| Magenta coupler (Ex-M2): | |

-continued

Third layer (magenta color-generating emulsion layer)

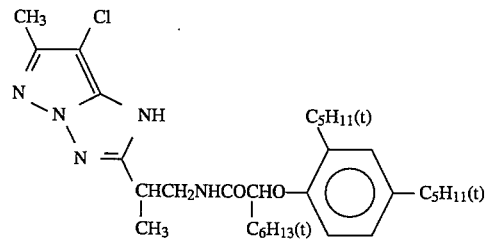

These samples were measured for K(br) and K(rr). Sample Nos. 1 to 5 showed K(br)=0.59 and K(rr)=0.18 and sample Nos. 6 to 10 showed K(br)=0.46 and K(rr)=0.09.

Sample Nos. 6 to 10 were subjected to the shade reproduction test using a pictorial image as in Example 1, finding better results.

Example 4

Several photosensitive materials having different spectral sensitivities as shown in FIGS. 7 and 8 were prepared as follows. Multilayer color photosensitive materials of the combination shown below were prepared by using a silver chlorobromide emulsion chemically sensitized by sulfur sensitization and gold sensitization (containing cubic silver halide grains of the core/shell structure having an average silver bromide content of 70.0%, consisting of a core of pure silver bromide occupying 30% of the grain and a shell of silver chlorobromide containing 57.0% of silver bromide, and having a mean grain size of 0.41 μm with a coefficient of variation of 15.8%) and combining it with the spectral sensitizing dye used in Example 1.

TABLE 7A

| Sample | No. 11 | No. 12 | No. 13 |
|---|---|---|---|
| Yellow color generating layer | Dye C $5 \times 10^{-6}$ | Dye C $5 \times 10^{-6}$ | Dye C $5 \times 10^{-6}$ |
| Cyan color generating layer | Dye B $5 \times 10^{-6}$ | Dye B $3 \times 10^{-6}$ | Dye E $5 \times 10^{-6}$ |
| Magenta color generating layer | Dye A $1 \times 10^{-4}$ | Dye A $1 \times 10^{-4}$ | Dye A $1 \times 10^{-4}$ |

*unit in mol/mol of Ag

TABLE 7B

Layer arrangement

| Layer | Additives | Coverage (g/m$^2$) |
|---|---|---|
| 7th layer: protective layer | | |
| | Gelatin | 0.264 |
| | Matte agent | 0.018 |
| | $Zn(OH)_2$ | 0.964 |
| | Surfactant (1) | 0.028 |
| | Surfactant (2) | 0.011 |
| | Water-soluble polymer (1) | 0.004 |
| 6th layer: intermediate layer | | |
| | Gelatin | 0.762 |
| | Surfactant (1) | 0.007 |
| | Surfactant (2) | 0.022 |
| | Water-soluble polymer (1) | 0.016 |
| 5th layer: red (670 nm) sensitive layer | | |
| | Emulsion (see Table 7A) | 0.205 (Ag) |

TABLE 7B-continued

Layer arrangement

| Layer | Additives | Coverage ($g/m^2$) |
|---|---|---|
| | Magenta dye-providing substance(A) | 0.2845 |
| | High-boiling solvent (2) | 0.100 |
| | Reducing agent | 0.016 |
| | Antifoggant (1) | 0.004 |
| | Surfactant (3) | 0.007 |
| | Gelatin | 0.297 |
| | Antifoggant (3) | 0.0004 |
| | Water-soluble polymer (1) | 0.007 |
| 4th layer: Intermediate layer | | |
| | Hardener | 0.058 |
| | Gelatin | 0.629 |
| | Surfactant (1) | 0.009 |
| | Surfactant (4) | 0.046 |
| | Water-soluble polymer (1) | 0.012 |
| 3rd layer: near infrared (750 nm) sensitive layer | | |
| | Emulsion (see Table 7A) | 0.211 (Ag) |
| | Cyan dye-providing substance ($B_1$) | 0.132 |
| | Cyan dye-providing substance ($B_2$) | 0.1983 |
| | High-boiling solvent (1) | 0.1778 |
| | Reducing agent | 0.018 |
| | Antifoggant (1) | 0.005 |
| | Surfactant (3) | 0.007 |
| | Gelatin | 0.284 |
| | Antifoggant (2) | 0.0003 |
| | Stabilizer | 0.0043 |
| | Water-soluble polymer (1) | 0.010 |
| 2nd layer: intermediate layer | | |
| | Gelatin | 0.629 |

TABLE 7B-continued

Layer arrangement

| Layer | Additives | Coverage ($g/m^2$) |
|---|---|---|
| | Surfactant (1) | 0.006 |
| | Surfactant (4) | 0.057 |
| | Water-soluble polymer (1) | 0.009 |
| 1st layer: infrared (810 nm) sensitive layer | | |
| | Emulsion (see Table 7A) | 0.215 (Ag) |
| | Antifoggant (2) | $8.4 \times 10^{-4}$ |
| | Yellow dye-providing substance (C) | 0.429 |
| | Dyestuff | 0.049 |
| | High-boiling solvent (1) | 0.172 |
| | Reducing agent | 0.023 |
| | Antifoggant (1) | 0.003 |
| | Surfactant (3) | 0.034 |
| | Gelatin | 0.338 |
| | Stabilizer | 0.0054 |
| | Water-soluble polymer (1) | 0.014 |
| Support | Polyethylene-laminated neutral paper of 120 μm thick | |

Sample Nos. 11, 12 and 13 had spectral sensitivity profiles similar to those of sample Nos. 2, 4 and 5 shown in FIG. 8, respectively.

The chemicals used herein are given below.

High-boiling organic solvent (1): triisononyl phosphate

High-boiling organic solvent (2): trihexyl phosphate

Magenta dye-providing substance (A)

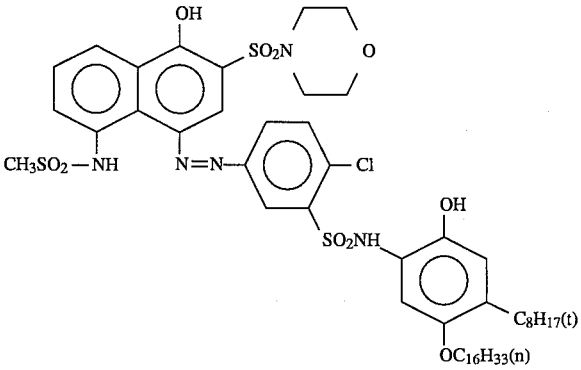

Cyan dye-providing substance ($B_1$):

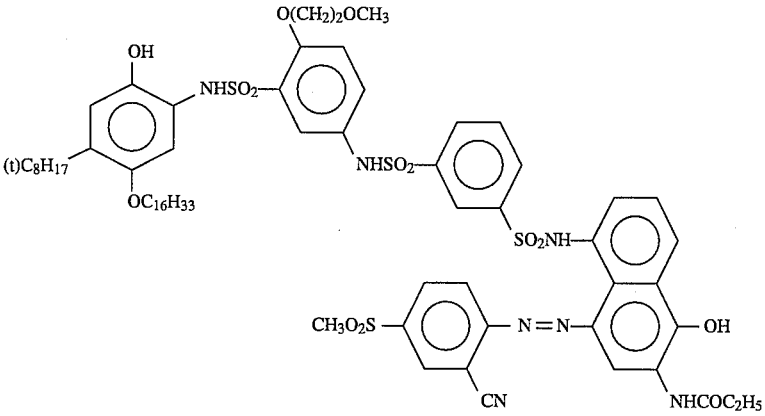

Cyan dye-providing substance ($B_2$):

-continued
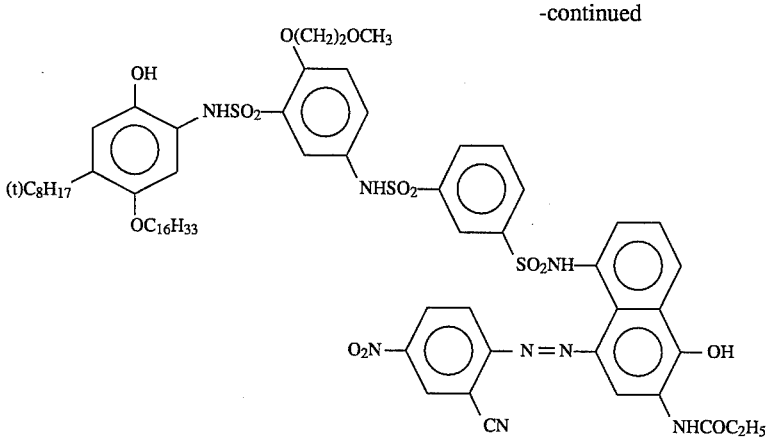
Yellow dye-providing substance (C):
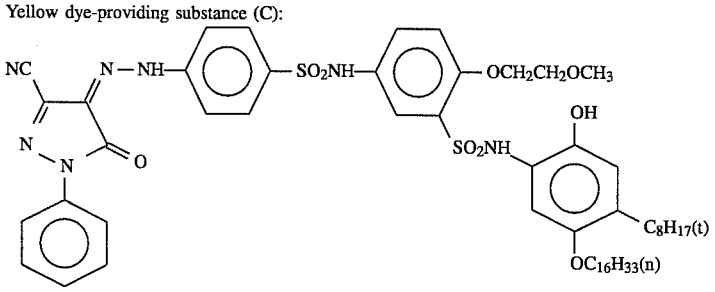
Reducing agent:
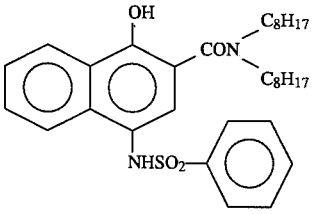
Antifoggant (1):
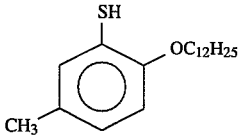
Antifoggant (2):
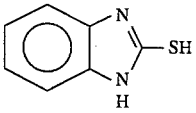
Antifoggant (3):
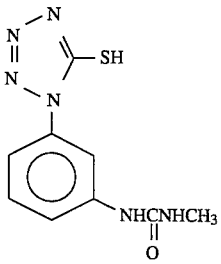
Surfactant (1): Aerosol OT
Surfactant (2):

-continued

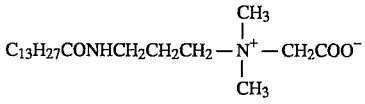

Surfactant (3):

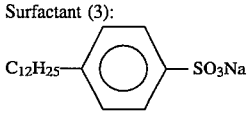

Surfactant (4):

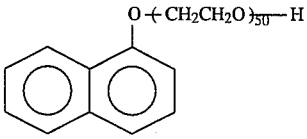

Hardener:

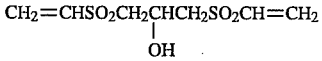

Stabilizer:

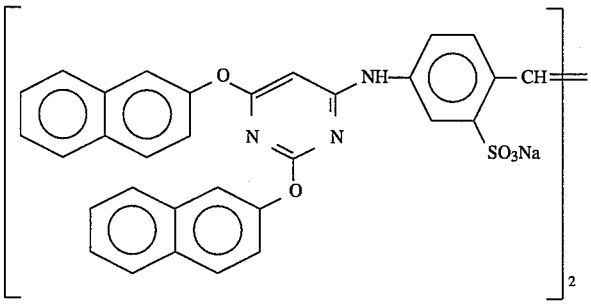

Dyestuff:

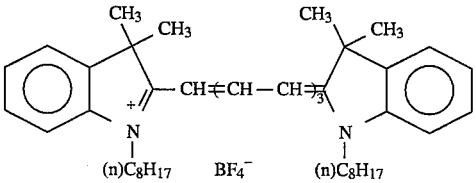

Water-soluble polymer (1):

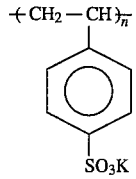

A dye-fixing material was prepared in accordance with Table 7C.

Polymer*5: vinyl alcohol/sodium acrylate copolymer (75/25 molar ratio)

Polymer*7: dextran (MW=70,000)

High-boiling solvent*8: Rheophos 95 (Ajinomoto K. K.)

Matte agent*10: benzoanamine resin containing 18% by volume of particles in excess of 10 μm

TABLE 7C

Layer arrangement

| Layer | Additives | Coverage ($mg/m^2$) |
|---|---|---|
| 3rd layer: | Gelatin | 0.05 |
| | Silicone oil*1 | 0.04 |
| | Surfactant*2 | 0.001 |
| | Surfactant*3 | 0.02 |
| | Surfactant*4 | 0.10 |
| | Guanidine picolinate | 0.45 |
| | Polymer*5 | 0.24 |
| 2nd layer: | Mordant*6 | 2.35 |
| | Polymer*7 | 0.60 |

TABLE 7C-continued

| Layer arrangement | | |
|---|---|---|
| Layer | Additives | Coverage (mg/m$^2$) |
| | Gelatin | 1.40 |
| | Polymer*5 | 0.21 |
| | High-boiling solvent*8 | 1.40 |
| | Guanidine picolinate | 1.80 |
| | Surfactant*2 | 0.02 |
| 1st layer: | Gelatin | 0.45 |
| | Surfactant*4 | 0.01 |
| | Polymer*5 | 0.04 |
| | Hardener*9 | 0.30 |
| Support | Polyethylene-laminated neutral paper of 170 μm thick | |
| 1st back layer | Gelatin | 3.25 |
| | Hardener*9 | 0.25 |
| 2nd back layer | Gelatin | 0.44 |
| | Silicone oil*1 | 0.08 |
| | Surfactant*2 | 0.002 |
| | Matte agent*10 | 0.09 |
| | Surfactant*11 | 0.01 |

The chemicals used herein are given below.

Silicone oil*1:

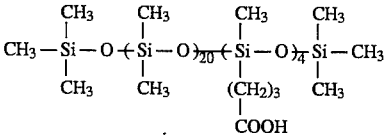

Surfactant*3:

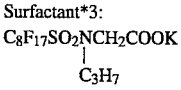

Surfactant*4:

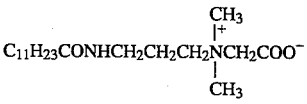

Surfactant*11:

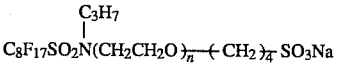

Mordant*6:

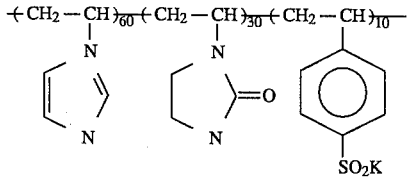

Mordant*9:

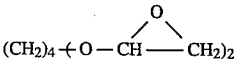

Using these heat developable photosensitive materials, the following test was carried out.

An exposure device providing the following exposure method was furnished as in Example 2.

| | Exposure method D |
|---|---|
| Semiconductor laser for | 810 nm, GaAlAs |

-continued

| | Exposure method D |
|---|---|
| yellow color-generating layer | |
| Semiconductor laser for cyan color-generating layer | 750 nm, GaAlAs |
| Semiconductor laser for magenta color-generating layer | 670 nm, AlGaInP |

First, the sample was subjected to wedgewise exposure for sensitometry by sole oscillation of the semiconductor laser (670 nm) for magenta color-generating layer. Then water was applied to the emulsion surface of the exposed photosensitive material by means of a wire bar in an amount of 11 ml/m$^2$, and the dye fixing material was placed thereon such that their active surfaces came in close contact. The assembly was heated for 25 seconds by means of a heat roller such that the water-absorbed coatings reached a temperature of 85° C. Thereafter, the photosensitive material was stripped from the dye fixing material which had an image borne thereon.

The reflection densities (G, R) of the magenta color generated sample were measured to determine a characteristic curve of the magenta color generated image and the magenta density at which color generation of a cyan image complementary to the magenta started.

The results are shown in Table 8.

TABLE 8

| Sample No. | Magenta density at the start of cyan color generation |
|---|---|
| 11 | D(M) = 2.28 |
| 12 | not observed in the dynamic range of magenta color generation |
| 13 | D(M) = 1.96 |

Next a pictorial image reproduction test was carried out. Using the same pictorial image data concerning a red sweater wearing woman having a crimson rose as used in Example 1, an image was input in the heat developable photosensitive material, which was heat developed as described above. In this way, 30 prints were continuously prepared for each sample. Color matching between the output image and the original image was adjusted at the beginning of the test for each sample. The 30 prints were evaluated for a variation of delicate shades in the rose flower and sweater.

The results are shown in Table 9.

TABLE 9

| Sample No. | Stability of duplicate shades |
|---|---|
| 11 | insufficient shade reproduction in 2 of 30 prints |
| 12 | practically unacceptable large variation |
| 13 | approximately stable shade reproduction |

It is thus evident that the present invention is equally effective when applied to heat developable photosensitive material.

In forming an image in a photosensitive material comprising a plurality of dye-forming layers, for example, at least a magenta dye-forming layer, a cyan dye-forming layer and a yellow dye-forming layer, the present invention ensures that a plurality of dye-forming layers are simultaneously color generated by sole exposure to light from at least one light source, more particularly, a dye-forming layer having maximum sensitivity to the sole exposure of the light source and a dye-forming layer of a color generating dye complementary to the color generating dye of the maximum sensitivity dye-forming layer are simultaneously color generated, whereby delicate low density color generation of the complementary dye is introduced in high density color generation of the maximum sensitivity color generating dye while the delicate variation of color generation density of the complementary dye is accurately and stably controlled to below the visual threshold density.

According to the invention, images with a high degree of saturation, especially images of high purity reddish color, for example, a crimson rose and red velvet dress can be accurately and stably depicted including shades in details. Images of high quality can be formed even at a high degree of saturation. Thus the process of the invention is successful in reproducing images of high quality while accomplishing not only reproduction of high purity colors, but also reproduction of delicate shades contained therein.

I claim:

1. A process for forming an image, comprising the steps of:

modulating a plurality of light sources adapted to emit a corresponding plurality of light beams having different narrow band wavelengths in accordance with image data, writing the image in a silver halide color photosensitive material having on a support a plurality of dye image forming layers using the modulated light beams, each layer providing a dye image having a different color by development and exhibiting a highest sensitivity at a different wavelength from that exhibited by the other layers, and developing said silver halide color photosensitive material, wherein the writing in at least one of the dye image forming layers comprises exposing a dye image forming layer (A) using a light source providing a highest spectral sensitivity to another dye image forming layer (B) within the exposing range of the layer (A) so that the color density difference, corresponding to a minimum change of a modulation control of an exposure quantity of said light source, created in the layer (A) by said exposure and development is less than visual threshold, and wherein said exposing range of the layer (A) is the exposure quantity range in which the color density created by exposure using a light source providing a highest spectral sensitivity to the layer (A) and development varies greater than the visual threshold with respect to a minimum change of a modulation control of an exposure quantity.

2. An image forming process according to claim 1 wherein said photosensitive material has at least a yellow dye-forming layer, a magenta dye-forming layer and a cyan dye-forming layer on the support, said plurality of light sources are at least three laser light sources having different wavelengths, and modulation of said plurality of light sources is carried out in accordance with a signal conversion scheme computed from red, green and blue components of the image data, respectively.

3. An image forming process according to claim 2 wherein the magenta dye-forming layer in said photosensitive material contains a dye forming element in the form of a compound capable of forming a magenta dye through a coupling reaction with an oxidized form of an aromatic primary amine developing agent, and in the absorption spectrum profile of the photosensitive material provided on color generation of monochromatic magenta, the following relationship is met:

$$K(br) \leqq .56 \text{ or } K(rr) \leqq .18$$

where the photosensitive material uses a reflective support, or $$K(bt) \leqq .44 \text{ or } K(rt) \leqq .09$$

where the photosensitive material uses a transparent support.

4. An image forming process according to claim 2 wherein the magenta dye-forming layer in said photosensitive material contains a dye forming element in the form of a compound capable of forming a magenta dye through coupling reaction with an oxidized form or an aromatic primary amine developing agent, said compound being represented by the general formula (I):

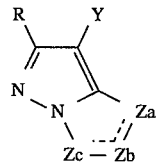

(I)

wherein R is selected from the group consisting of a hydrogen atom, an alkyl group, a cycloalkyl group and a phenoxy group, Y is a hydrogen atom or a coupling-off radical, and Za, Zb, and Zc are selected from the group consisting of methine, methine substituted by an alkyl group, methine substituted by a phenyl group, =N—, and —NH—, and form a five-membered azole ring containing two to four nitrogen atoms.

5. An image forming process according to claim 4, wherein R represents an alkyl group substituted by a phenoxy group or a phenoxy group substituted by a methoxy group.

6. An image forming process according to claim 4, wherein Za, Zb, and Zc are selected from the group consisting of (1) a methine group which is substituted with an alkyl group, said alkyl group being substituted with a ballast group, and (2) a methine group which is substituted with a phenyl group, said phenyl group being substituted with a ballast group.

7. A process for forming an image according to claim 1 wherein said visual threshold is 0.005 as a density difference.

8. A process for forming a color image, comprising the steps of:

modulating a plurality of light sources in accordance with image data, writing the image using said plurality of light sources in a silver halide color photosensitive material having on a support photosensitive emulsion layers including at least a yellow dye image forming layer, a magenta dye image forming layer and a cyan dye image forming layer, and developing said silver halide color photosensitive material, wherein said plurality of light sources includes at least three laser light sources emitting three respective laser beams, each laser beam having a different wavelength, modulation of said plurality of light sources is carried out in accordance with a signal conversion scheme computed from red, green, and blue components of the image data, respectively, at least one laser light source is capable of creating a latent image in plural photosensitive emulsion layers upon sole exposure thereto to provide dye images having different color by development, and the setting of the wavelength of the corresponding laser beam of the laser light source and/or the spectral sensitivity distribution of the photosensitive emulsion layers is adjusted in such a way that within the exposure range of the photosensitive emulsion layer having the highest spectral sensitivity among said plural photosensitive emulsion layers upon sole exposure to said laser light source which is capable of creating a latent image, at least one dye image having complementary color to a color of a dye image of said photosensitive emulsion layer having the highest spectral sensitivity, is additionally generated in one of the other emulsion layers so as to provide a gradation.

9. An image forming process according to claim 8 wherein the magenta dye-forming layer in said photosensitive material contains a dye forming element in the form of a compound capable of forming a magenta dye through a coupling reaction with an oxidized form of an aromatic primary amine developing agent, and in the absorption spectrum profile of the photosensitive material provided on color generation of monochromatic magenta, the following relationship is met:

$$K(br) \leqq 0.56 \text{ or } K(rr) \leqq 0.18$$

where the photosensitive material uses a reflective support, or $$K(bt) \leqq 0.44 \text{ or } K(rt) \leqq 0.09$$

where the photosensitive material uses a transparent support.

10. An image forming process according to claim 8 wherein the magenta dye-forming layer in said photosensitive material contains a dye forming element in the form of a compound capable of forming a magenta dye through a coupling reaction with an oxidized form of an aromatic primary amine developing agent, said compound being represented by the general formula (I):

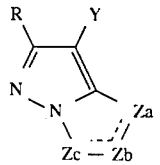

(I)

wherein R is selected from the group consisting of a hydrogen atom, an alkyl group, a cycloalkyl group and a phenoxy group, Y is a hydrogen atom or a coupling-off radical, and Za, Zb, and Zc are selected from the group consisting of methine, methine substituted by an alkyl group, methine substituted by a phenyl group, =N—, and —N—, and form a five-membered azole ring containing two to four nitrogen atoms.

11. An image forming process according to claim 10, wherein Za, Zb, and Zc are selected from the group consisting of (1) a methine group which is substituted with an alkyl group, said alkyl group being substituted with a ballast group, and (2) a methine group which is substituted with a phenyl group, said phenyl group being substituted with a ballast group.

12. An image forming process according to claim 10, wherein R represents an alkyl group substituted by a phenoxy group or a phenoxy group substituted by a methoxy group.

13. A process for forming an image, comprising the steps of:

modulating a plurality of light sources in accordance with image data, writing the image using said plurality of light sources in a silver halide color photosensitive material having on a support photosensitive emulsion layers including at least a yellow dye image forming layer, a magenta dye image forming layer and a cyan dye image forming layer, and developing said silver halide color photosensitive material, wherein modulation of said plurality of light sources is carried out in accordance with a signal conversion scheme computed from red, green, and blue components of the image data, respectively, wherein at least one light source is capable of creating a latent image in plural emulsion layers including an emulsion layer (C) exhibiting the highest spectral sensitivity to said at least one light source and another emulsion layer (D) upon sole exposure thereto and said another emulsion layer (D) provides upon development a dye image having a complementary color to a color of a dye image which said highest spectral sensitivity emulsion layer (C) provides upon development, wherein the writing in said another emulsion layer (D) comprises exposing the layer (D) using said at least one light source within the exposing range of the layer (D) so that the color density difference created by said exposure and development is less than visual threshold, and wherein said exposing range of the layer (D) is the exposure quantity range in which the color density created in the layer (D) by exposure using another light source providing a highest spectral sensitivity to the layer (D) and development varies greater than the visual threshold with respect to a minimum change of a modulation control of an exposure quantity.

14. An image forming process according to claim 13 wherein color activation of the complementary dye upon sole exposure to said one light source capable of causing color activation in plural emulsion layers is added to a density region above a certain value set between 1.5 and 2.5 in the image density of the color generating dye of the emulsion layer exhibiting the highest sensitivity upon sole exposure to said one light source while providing a gradation.

15. An image forming process according to claim 13, wherein the magenta dye-forming layer in said photosensitive material contains a dye forming element in the form of a compound capable of forming a magenta dye through a coupling reaction with an oxidized form of an aromatic primary amine developing agent, and in the absorption spectrum profile of the photosensitive material provided on color generation of monochromatic magenta, the following relationship is met:

$$K(br) \leqq 0.56 \text{ or } K(rr) \leqq 0.18$$

where the photosensitive material uses a reflective support, or $$K(bt) \leqq 0.44 \text{ or } K(rt) \leqq 0.09$$

where the photosensitive material uses a transparent support.

16. A process for forming an image according to claim 13 wherein said visual threshold is 0.005 as a density difference.

17. An image forming process according to claim 13, wherein the magenta dye-forming layer in said photosensitive material contains a dye forming element in the form of a compound capable of forming a magenta dye through a coupling reaction with an oxidized form of an aromatic primary amine developing agent, said compound being represented by the general formula (I):

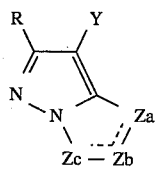

(I)

wherein R is selected from the group consisting of a hydrogen atom, an alkyl group, a cycloalkyl group and a phenoxy group.

Y is a hydrogen atom or a coupling-off radical, and

Za, Zb, and Zc are selected from the group consisting of methine, methine substituted by an alkyl group, methine substituted by a phenyl group =N—, and —NH—, and form a five-membered azole ring containing two to four nitrogen atoms.

18. An image forming process according to claim 17, wherein R represents an alkyl group substituted by a phenoxy group or a phenoxy group substituted by a methoxy group.

19. An image forming process according to claim 17, wherein Za, Zb, and Zc are selected from the group consisting of (1) a methine group which is substituted with an alkyl group, said alkyl group being substituted with a ballast group, and (2) a methine group which is substituted with a phenyl group, said phenyl group being substituted with a ballast group.

* * * * *